US008590261B2

(12) United States Patent
Deiss et al.

(10) Patent No.: US 8,590,261 B2
(45) **Date of Patent: *Nov. 26, 2013**

(54) METHOD FOR SEALING OF REPLACEMENT WINDOWS

(71) Applicant: ISO-Chemie GmbH, Aalen (DE)

(72) Inventors: Martin Deiss, Abtsgmuend (DE); Andreas Lange, Urbach (DE)

(73) Assignee: ISO-Chemie GmbH (DE)

( * ) Notice: Subject to any disclaimer, the term of this patent is extended or adjusted under 35 U.S.C. 154(b) by 22 days.

This patent is subject to a terminal disclaimer.

(21) Appl. No.: 13/652,839

(22) Filed: Oct. 16, 2012

(65) Prior Publication Data

US 2013/0097963 A1 Apr. 25, 2013

(30) Foreign Application Priority Data

Oct. 19, 2011 (EP) ..... 11185762

(51) Int. Cl.
*E04B 1/00* (2006.01)

(52) U.S. Cl.
USPC ..... 52/741.4; 52/211; 52/309.4; 52/514; 52/745.16; 52/745.15; 49/475.1; 49/466

(58) Field of Classification Search
USPC ..... 52/745.16, 784.15, 717.01, 745.15, 52/717.03, 741.4, 211, 309.7, 309.5, 52/309.1, 309.4, 656.5, 309.6, 309.11, 52/309.13, 309.16, 514, 514.5, 373, 407.1, 52/202, 741.1; 49/475.1, 466; 428/304.4, 428/317.3, 71, 40.1, 41.8, 42.3; 277/312
See application file for complete search history.

(56) References Cited

U.S. PATENT DOCUMENTS

| | | | | |
|---|---|---|---|---|
| 3,213,584 | A * | 10/1965 | Bush | 277/649 |
| 4,311,656 | A * | 1/1982 | Spriggs | 264/36.2 |
| 4,392,335 | A * | 7/1983 | Heiman | 52/309.17 |
| 4,711,061 | A * | 12/1987 | Wilkinson et al. | 52/410 |
| 5,197,250 | A * | 3/1993 | Kramer | 52/396.04 |
| 6,263,636 | B1 * | 7/2001 | Corston | 52/741.1 |
| 6,532,714 | B1 * | 3/2003 | Ferm et al. | 52/742.12 |
| 6,898,907 | B2 * | 5/2005 | Diamond | 52/202 |
| 7,249,444 | B2 * | 7/2007 | Diamond | 52/514 |
| 7,754,304 | B1 * | 7/2010 | Hohmann, Jr. | 428/40.1 |

(Continued)

FOREIGN PATENT DOCUMENTS

| | | | |
|---|---|---|---|
| DE | 202005013196 | U1 | 10/2005 |
| EP | 2333177 | A1 | 6/2011 |

*Primary Examiner* — Chi Q Nguyen
(74) *Attorney, Agent, or Firm* — Jansson Munger McKinley & Shape Ltd.

(57) ABSTRACT

In the method for sealing of replacement windows a sealing tape with a first layer of flexible foam and a second layer of stiff material is inserted into a channel-shaped recess in masonry so that the first layer of the sealing tape is oriented toward the bottom of the recess and is at least partially compressed. The expansion of the first layer is temporarily limited by clamping the second layer directly or indirectly against the side walls of the recess, or by use of retaining elements, which exert a retaining function on the second layer. A window frame is installed in an area of the recess during the temporary limitation of the expansion of the first layer of the sealing tape, whereupon the first layer expands further or is allowed to expand further until the sealing tape rests against the window frame.

15 Claims, 20 Drawing Sheets

(56) References Cited

U.S. PATENT DOCUMENTS

| | | | | |
|---|---|---|---|---|
| 7,871,121 | B1 * | 1/2011 | Ragsdale | 296/180.2 |
| 8,272,117 | B2 * | 9/2012 | Michaud | 29/451 |
| 8,302,364 | B2 * | 11/2012 | Hohmann, Jr. | 52/745.15 |
| 2011/0143122 | A1 | 6/2011 | Deiss | |
| 2011/0185661 | A1 | 8/2011 | Nauck et al. | |
| 2011/0302873 | A1 | 12/2011 | Deiss | |

* cited by examiner

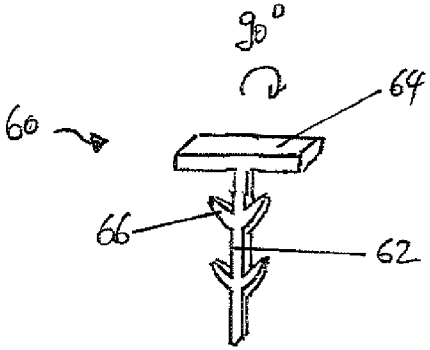
Fig. 7b
Fig. 7a
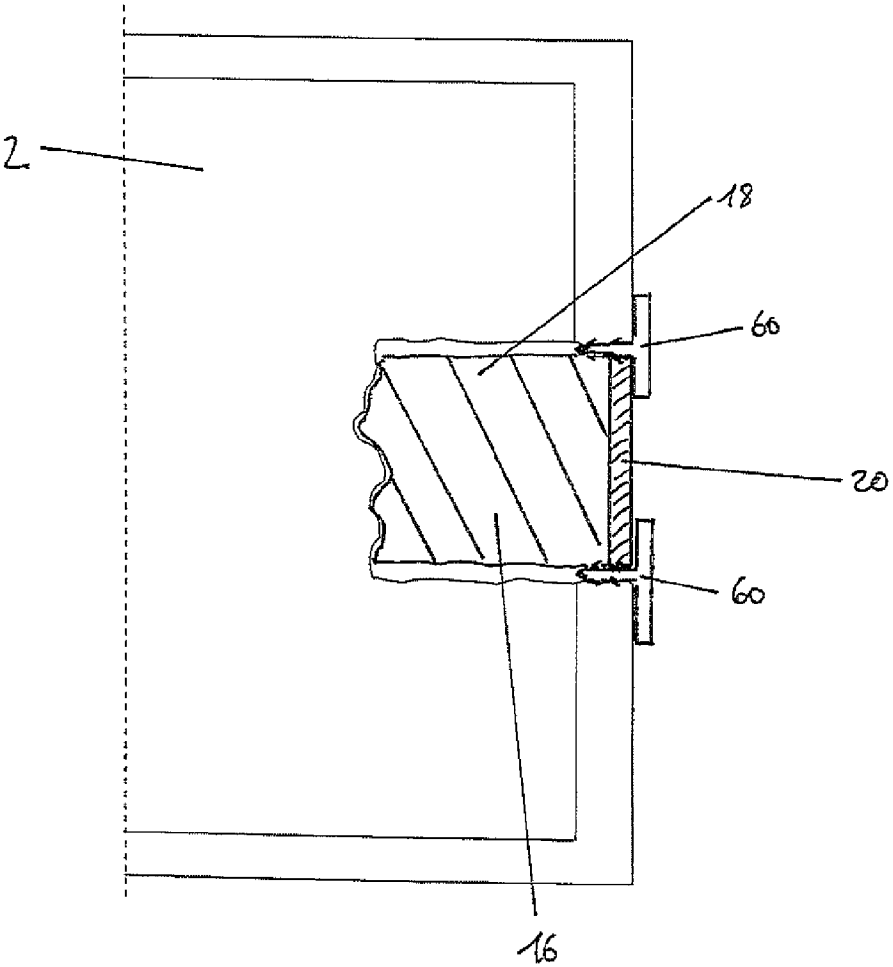

METHOD FOR SEALING OF REPLACEMENT WINDOWS

CROSS REFERENCE TO RELATED APPLICATION

This application claims priority based on European patent application EP 11 185 762.9 filed Oct. 19, 2011.

FIELD OF THE INVENTION

The present invention relates to a method for sealing of replacement windows.

BACKGROUND OF THE INVENTION

When windows are being replaced, the usual procedure is first to remove the old window from the masonry wall by the use of, for example, a suitable window joint saw. Both the interior plastering and the exterior rendering are separated from the old window frame along a straight, sharply defined line and the old window frame is then taken out. As a result, the old window which has been removed leaves behind, on all sides, a channel-shaped recess between the interior plastering and the exterior rendering. This recess extends all the way to the rough masonry and can even penetrate into it. Such recesses vary in depth and are usually 10-100 mm deep.

Modern window frames are usually wider than old window frames, which means that, when a new window is being installed, the window frame cannot be inserted into the recess but rather must remain outside it. The recess extending all the way around must be filled with a sealing and insulating material, so that, after the new window has been installed, the space between the bottom of the recess and the new window frame is sealed in a manner consistent with good building insulation as defined by the generally recognized rules of the technology.

Injected polyurethane foams or mineral fiber insulating materials, for example, have been used in the past to seal these recesses. Sealing tapes of flexible foam are also used.

In the case of the latter option, flexible foam sealing tapes are attached directly to the new window frame. For example, a window frame equipped with a flexible foam sealing tape is known from US 2011/0185661 A1. The sealing tape can be held in place between the opposing angled edges of two molding profile strips on the window frame. This is done by introducing the stiff layer, on which the flexible foam is mounted, into the intermediate space between the molding profile strips, where it is prevented from slipping out of position by the angled edges. The stiff layer is then destroyed to release the foam, which can finally expand and seal the window frame in the direction toward the masonry. In the case of the previously mentioned process of window replacement, however, it is very difficult to reach the stiff layer after the new window frame has been brought into the desired installation position, and it is also impossible to see whether or not the recess has been sealed completely with the flexible foam strip.

According to US 2011/0143122 A1 and US 2011/0302873 A1, the sealing tape again comprises a layer of flexible foam and a stiff layer. Here, the stiff layer does not have to be destroyed to release the flexible foam, and the flexible foam is arranged on the side of the stiff layer facing the masonry. The stiff layer can be premounted in profiled channels in the window frame by the use of various fastening mechanisms. However, it is still impossible to see whether or not the recess has been sealed completely with the flexible foam strip.

In summary, the combination of a window frame with a sealing tape already premounted on it is not optimally suitable for the window replacement process described above.

SUMMARY OF THE INVENTION

It is an object of the present invention to provide a method for sealing of replacement windows by means of which the sealing of the new window frame in the masonry can be ensured efficiently and reliably, and which at the same time can be carried out easily by the tradesman.

According to an aspect of the invention, the method for sealing of replacement windows comprises the steps of:

- providing a sealing tape comprising a first layer of flexible foam, which recovers after compression, and a second layer of stiff material;
- inserting the sealing tape into a channel-shaped recess in a masonry, the recess being bounded by a bottom and two side walls and comprising an open access section, wherein the first layer of the sealing tape is oriented toward the bottom of the recess and is at least partially compressed when in the inserted state;
- at least temporarily limiting an expansion of the first layer of the sealing tape by clamping the second layer directly against the side walls of the recess, by clamping the second layer indirectly against the side walls of the recess by use of an intermediate clamping aid member, or by using a plurality of retaining elements, which exert a retaining function on the second layer of the sealing tape; and
- installing a window frame in an area of the recess during the at least temporary limitation of the expansion of the first layer of the sealing tape;

whereupon the first layer of the sealing tape expands further or is allowed to expand further until the sealing tape rests against the window frame.

With a method such as this, it is possible to ensure that a channel-shaped recess in a masonry wall can be sealed or insulated completely and reliably without impeding the installation of the new window frame.

As outlined above, during the period in which the expansion of the first layer of the sealing tape is being at least temporarily limited, a window frame is placed in the area of the recess filled by the sealing tape. In this way, a two-stage process is created, according to which the channel-shaped recess in the masonry is first provided with the sealing tape, which is held at least temporarily in the partially compressed state and which does not expand against the window frame until after the window frame has been put in place.

In a first embodiment, the retaining elements comprise screws or nails, which are driven through the sealing tape and anchored in the bottom or side walls of the recess after the sealing tape has been fitted into the recess, wherein the heads of the screws or nails exert a retaining function on the second layer of the sealing tape. In this way, the stiff layer of the sealing tape is connected reliably and permanently to the masonry at a fixed distance to the bottom.

In another preferred embodiment, the retaining elements comprise flat retaining strips, which exert the retaining function on the second layer of the sealing tape. In this way, the sealing tape can be held flat in a partially compressed state without interfering with the installation of the new window frame.

In an elaboration of this embodiment, the retaining elements comprise, in addition to the retaining strips, screws or nails which, after the sealing tape has been fitted into the recess, are driven through the sealing tape and anchored in the bottom or side walls of the recess, wherein the heads of the screws or nails project slightly from the second layer of the sealing tape. The flat retaining strips, furthermore, comprise an opening in their middle section and are arranged between the heads of the screws or nails and the sealing tape, wherein the middle section of the flat retaining strips rests against the heads of the screws or nails from underneath after the retaining strips have been installed. Thus the function of retaining the sealing tape in the recess is ensured at several points, and simultaneously the sealing tape is kept in a predetermined state of expansion, whereas, after the new window frame has been put in place, the flat retaining strips can be easily removed, so that the sealing tape can expand all the way to the window frame.

The two side sections of the flat retaining strips preferably rest on the masonry, one on each side of the recess, after the retaining strips have been installed in order to define the exact location of the retaining strips.

In an alternative embodiment, the deliberate release of the retaining function is achieved by pulling on at least one laterally projecting pull element, which exerts a force on the second layer. The pull element is preferably permanently bonded to the second layer of the sealing tape, and it can be designed in the form of, for example, a sheet-like pull tab.

The sealing function and handling of the sealing tape can be further improved by making the second layer of the sealing tape out of stiff foam.

In an alternative embodiment, the second layer of sealing tape can comprise clamping sections projecting beyond the first layer of the sealing tape on both sides to clamp the tape against the side walls of the recess. As a result, regardless of the form and surface condition of the side walls of the recess, the sealing tape can be securely clamped in the recess without the use of any other aids.

To facilitate handling, the first layer and the second layer of the sealing tape are preferably permanently bonded to each other.

To improve the sealing properties and to allow the sealing tape to rest more closely against the contours of the installed window frame, the sealing tape preferably comprises a third layer of flexible foam, which is permanently bonded to the second layer of the sealing tape on the side of the second layer opposite the first layer.

To ensure that the recess is effectively sealed and that the flexible foam rests closely against the contours of the bottom of the recess even if those contours are irregular, the first layer of the sealing tape comprises, in special embodiment, a plurality of 3-dimensional foam segments, which are separated from each other by cuts, which extend from the top, i.e., from the side facing away from the second layer of the sealing tape, into the first layer of the sealing tape, wherein, when the first layer is in the expanded state, the foam segments extend over at least 50% of its height, preferably over at least 60% of its height, more preferably over at least 70% of its height, and even more preferably over 90% of its height.

To simplify production and to create uniform foam segments, a plurality of cuts is preferably substantially parallel to the side walls of the recess, and another plurality of cuts is substantially perpendicular to the side walls of the recess, so that the foam segments comprise a rectangular outline. Alternatively, the cuts can extend at an angle to the side walls of the recess, so that the foam segments comprise a rhombic outline. Other geometric forms are also conceivable, as is the use of dimpled foam.

BRIEF DESCRIPTION OF THE DRAWINGS

Additional features and advantages of the invention can be derived from the following description, which refers to the drawings.

FIGS. 6*a*-6*c* are cross-sectional views of the masonry wall of FIG. 1, illustrating the series of steps of the sealing process during window replacement according to another embodiment of the invention;

FIG. 7*a* is a cross-sectional view of the masonry wall of FIG. 1 with an alternative possibility for retaining the sealing tape;

FIG. 7*b* is a perspective view of the retaining clips used in FIG. 7*a;*

DETAILED DESCRIPTION OF THE INVENTION

Figure 1:
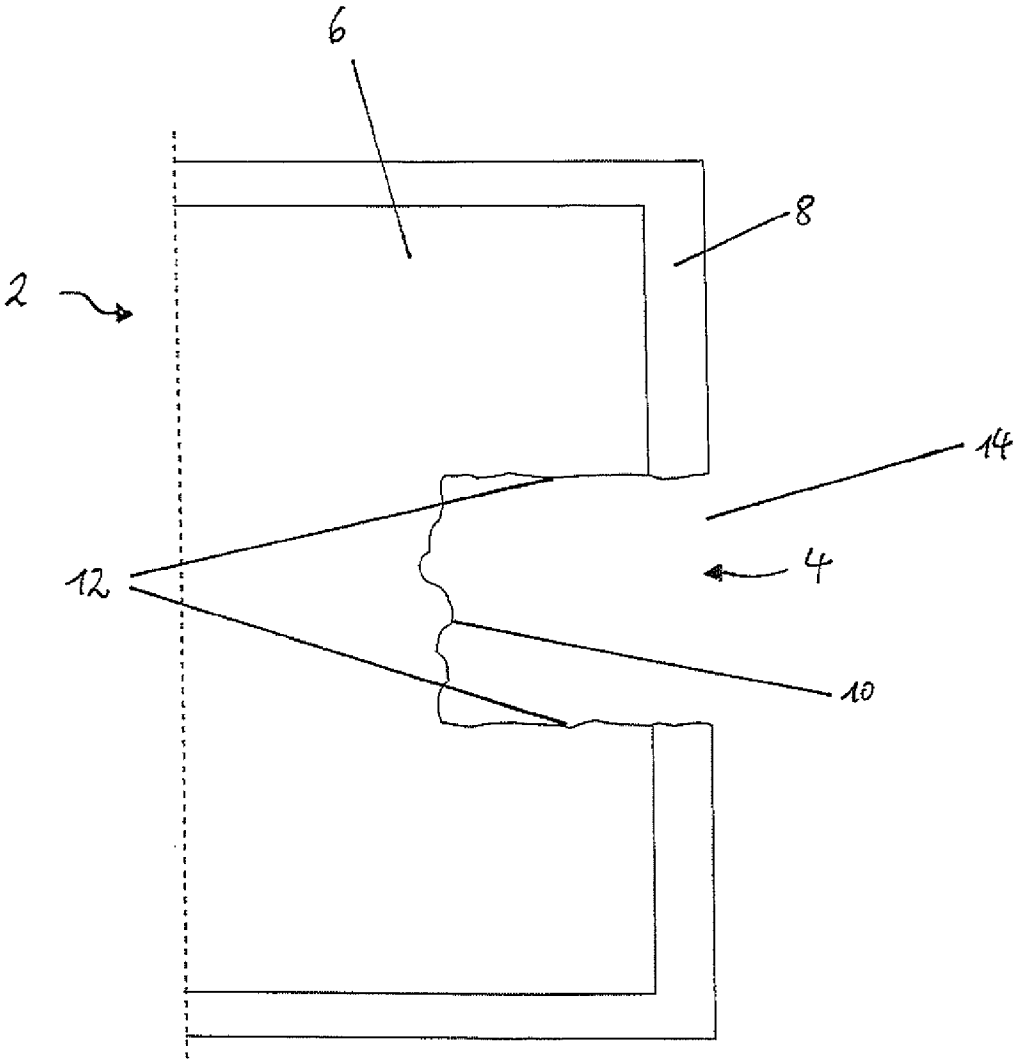
FIG. 1 is a cross-sectional view of a channel-shaped recess in the masonry wall of a building.

FIG. 1 shows the masonry 2 of a building, in which a recess 4 is present. Masonry 2 in the example shown here is formed out of a rough masonry core 6, over which plaster 8 has been applied. Recess 4 is in the shape of a channel and comprises a bottom 10, two side walls 12, and an access section 14 open to the outside.

Recesses 4 of this type in masonry 2 are usually encountered when a window is being replaced, that is, when the old window frame is cut out of masonry wall 2 with a window joint saw and removed. When the previously mentioned saw is used, side walls 12 of the resulting recess 4 are usually relatively smooth, whereas bottom 10 of recess 4 can be quite bumpy. It is obvious that recess 4 extends all the way around the opening and that the cross-sectional view in FIG. 1 shows only one of the usually four sides of the window opening in masonry 2.

The height of masonry 2 on one side of recess 4 can also be offset from that of masonry 2 on the other side of recess 4 (not shown), thus creating, for example, an outside stop for the window.

Figure 2A:
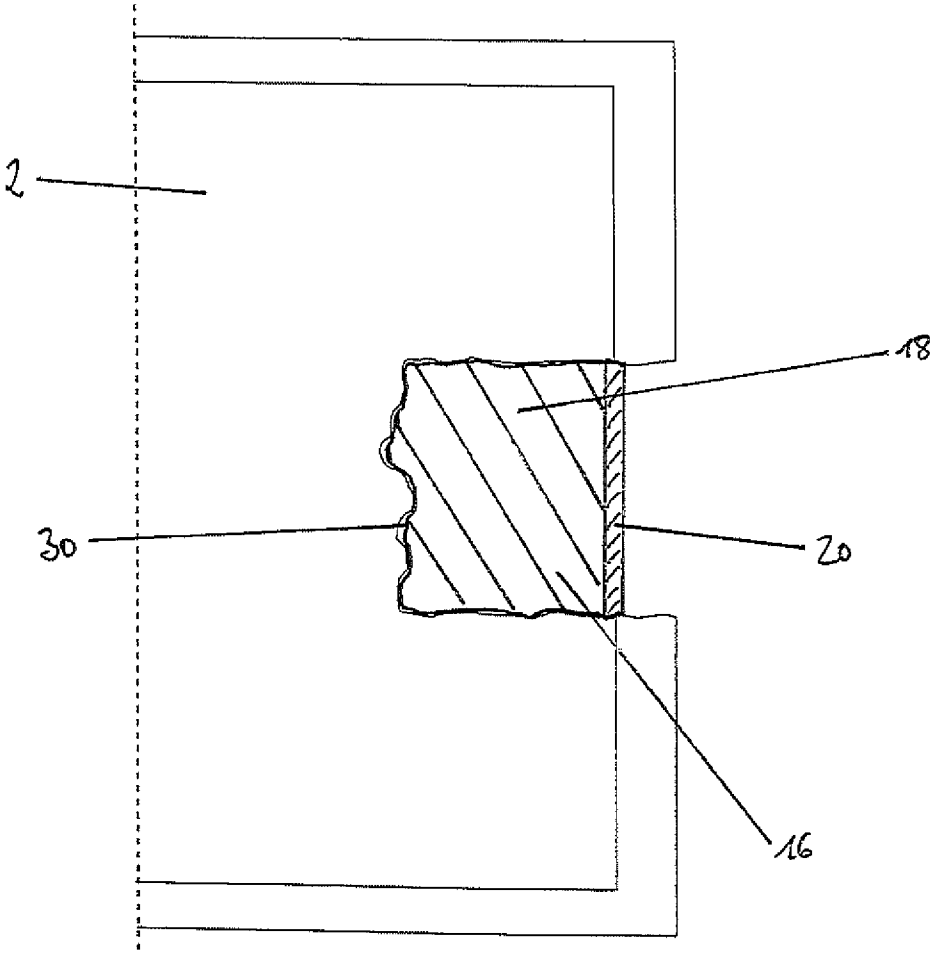
FIGS. 2*a*-2*c* are cross-sectional views of the masonry wall of FIG. 1, illustrating the series of steps of the sealing process during window replacement according to a first embodiment of the invention.

Sealing tape 16 is now introduced into the recess, as shown in FIG. 2*a*. In the exemplary embodiment shown, sealing tape 16 has a rectangular cross section, but other shapes are also possible. Basically, sealing tape 16 can be produced either in the form of strips or in the form of sealing tape rolls. Details of sealing tape 16 will now be described with reference to FIGS. 14 and 15.

Sealing tape 16 consists of a first layer 18 of flexible foam, which, in the expanded state, has a thickness in the range of 5-150 mm, preferably of 20-100 mm, and a width in the range of 10-250 mm, preferably of 40-100 mm.

First layer 18 of the sealing tape can be made of any desired open-cell or closed-cell flexible foam such as polyurethane or polyethylene foam which recovers after compression. The foam can be impregnated to delay its recovery after compression. The density of flexible foams of this type is usually in the range of 20-200 kg/m$^3$.

A second, thinner stiff layer 20 of the sealing tape is arranged on the bottom side of first layer 18 of the sealing tape. Second layer 20 is bonded to first layer 18 preferably by means of an adhesive or by lamination. The thickness of second layer 20 is in the range of 1-10 mm, preferably of 2-5 mm.

Figure 2B:
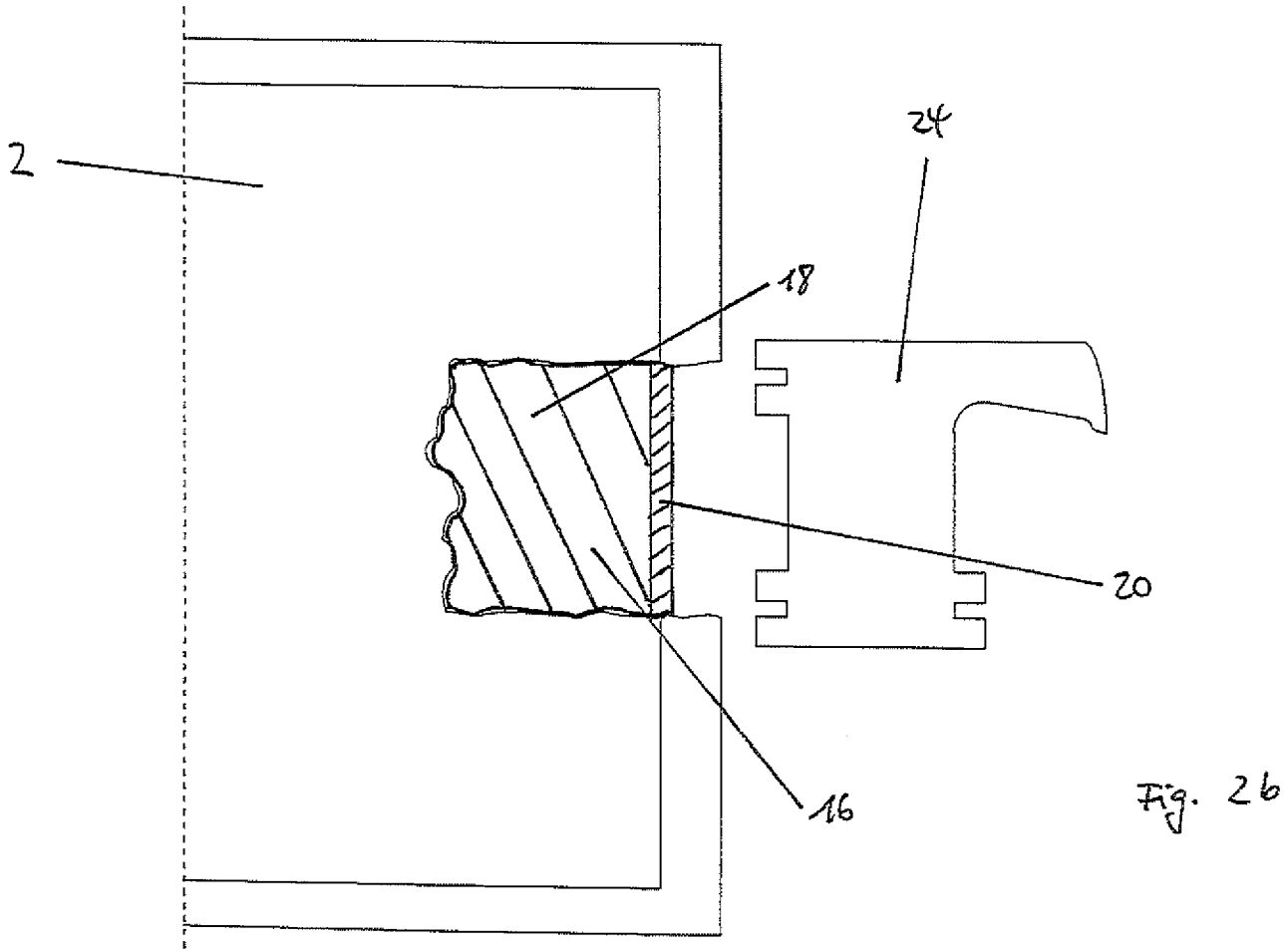
Figure 2C:
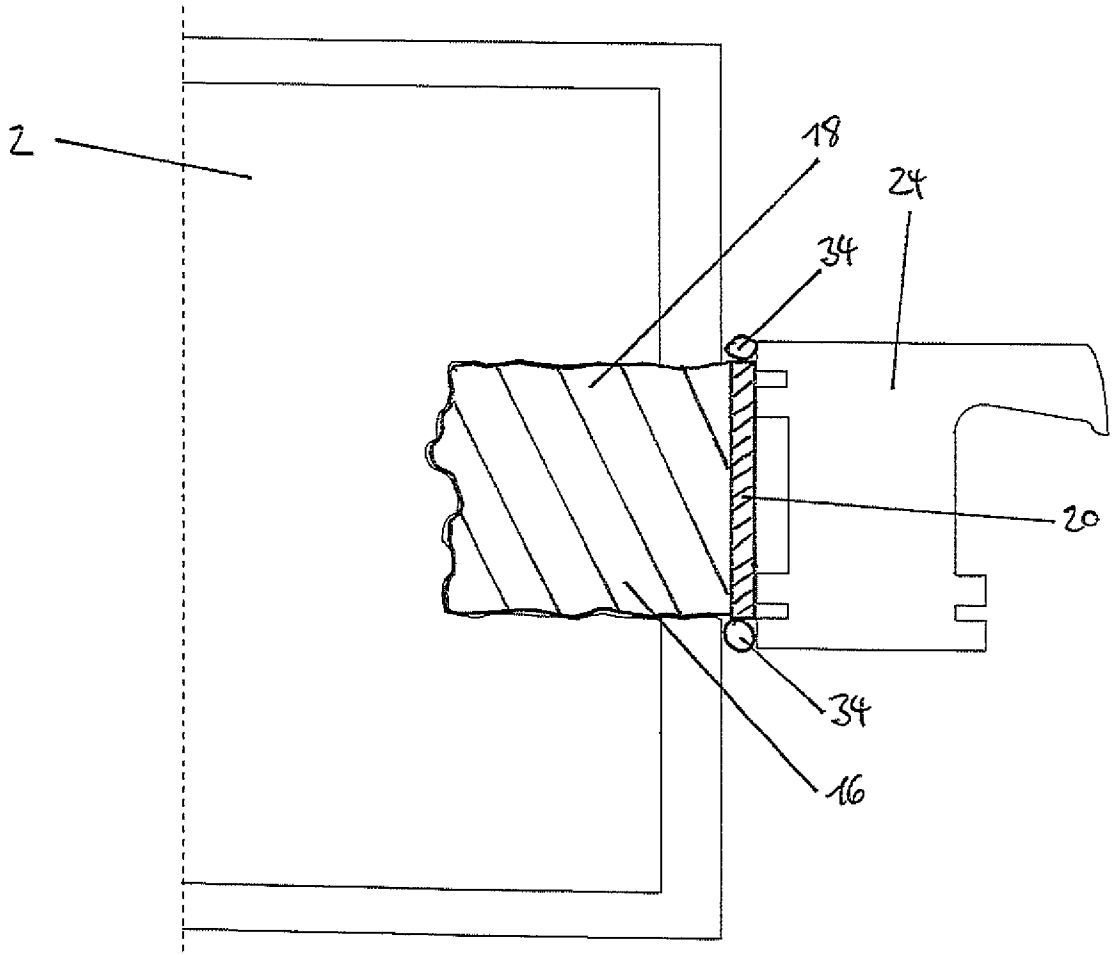

A foam of greater, preferably of much greater, stiffness than the flexible foam of first layer 18 is preferably provided as a material for second layer 20. For the stiff foam of second layer 20, therefore, plastics of foamed polyethylene or polypropylene can be considered. The stiff foam offers significant advantages especially in cases where sealing tape 16 is clamped in recess 4 without the use of additional fastening means (as shown in FIGS. 2*a*-2*c*).

The material of second layer 20 could also be a stiff material such as a nonwoven or mesh material. Strips of plastic or some other material which is suitable for the purpose indicated could also be used. Combinations of the materials mentioned above are also possible.

It is also possible to divide second layer 20 into two or more subsections arranged in series, these subsections not being attached to each other. It is also possible for two adjacent subsections of second layer 20 to be arranged a certain distance apart, so that the material of first layer 18 can expand into the resulting intermediate spaces and thus act as a kind of "shock absorber" between the two subsections of second layer 20.

Second layer 20 generally has a flexural strength of more than 200 kPa, preferably of more than 250 kPa. In a preferred embodiment, second layer 20 has a flexural strength of more than 300 kPa, preferably of more than 400 kPa. In an especially preferred embodiment, second layer 20 has a flexural strength of more than 500 kPa, preferably of more than 1,000 kPa, and even more preferably of more than 2,000 kPa. At the same time, the material of second layer 20 must be elastic enough not to break during the application according to the invention. 10,000 kPa, for example, represents an upper limit for the flexural strength.

The foam material of first layer 18, however, has a flexural strength of less than 150 kPa, preferably of less than 125 kPa, and more preferably of less than 100 kPa. In any case, however, it will always be more than 0 kPa.

The flexural strengths of the material of second layer 20 and of first layer 18 are determined on the basis of the standard ISO 1209-2, third edition, of 2007. This international standard is usually used to measure the flexural strength of plastics, but in somewhat modified form it is also an excellent way of measuring the flexural strength of foams.

A uniformly changing force is applied perpendicularly to the middle of a test piece extending between two support points. The flexural strength is calculated from the measured force-versus-deformation curve (see Section 3 of ISO 1209-2). The test apparatus is shown in greater detail in Section 4, FIG. 1. An example of a suitable testing device is the model BZ2.5/TN1S from Zwick of Ulm, Germany. In the present case, a model KAP-Z load cell for forces up to 200 N, for example, was used in the device.

The support points consist of two parallel cylindrical support elements, which are arranged horizontally in the same plane and each of which has a radius of 15±1 mm. The length of the support elements is greater than the width of the test pieces. In the present case, the support elements are 80 mm long.

The distance L between the support elements for the present measurement deviates from that of ISO 1209-2 and is fixed instead at 85±2 mm. The force-transmitting element has the same shape as the support elements. The other dimensions given in Section 5.1 of ISO 1209-2 are adjusted for the special purpose of measuring foams. Each measured foam test piece is a block with a length l of 150±3 mm, a width b of 40±2 mm, and a thickness d of 3.0±0.2 mm. Of the sets of test conditions described in Section 6 of ISO 1209-2, the first is used. That is, the measurement is carried out at a temperature of 23±2° C. and at a relative humidity of 50±10%. Instead of the velocity value given for the movement of the force-transmitting element in Section 7 of ISO 1209-2, a velocity of only 10±1 mm per minute is used here. In addition, the force is measured up to a maximum deflection of the foam of 20 mm, and the maximum value $F_R$ of the force observed during the course of the measurement is recorded.

The calculation of the flexural strength R (in kPa) is described in Section 8.1 of the ISO 1209-2, i.e. the formula $R=1.5\ F_R \cdot L/bd^2 \cdot 10^6$ is used, where $F_R$ is the maximum applied force in kN, L is the distance between the support elements in mm, b is the width of the test piece in mm, and d is the thickness of the test piece in mm.

For the values of L, b, and d given above, the results cited above for the material of second layer 20 and for that of the first layer 18 are obtained from the measured force $F_R$.

Figure 14:
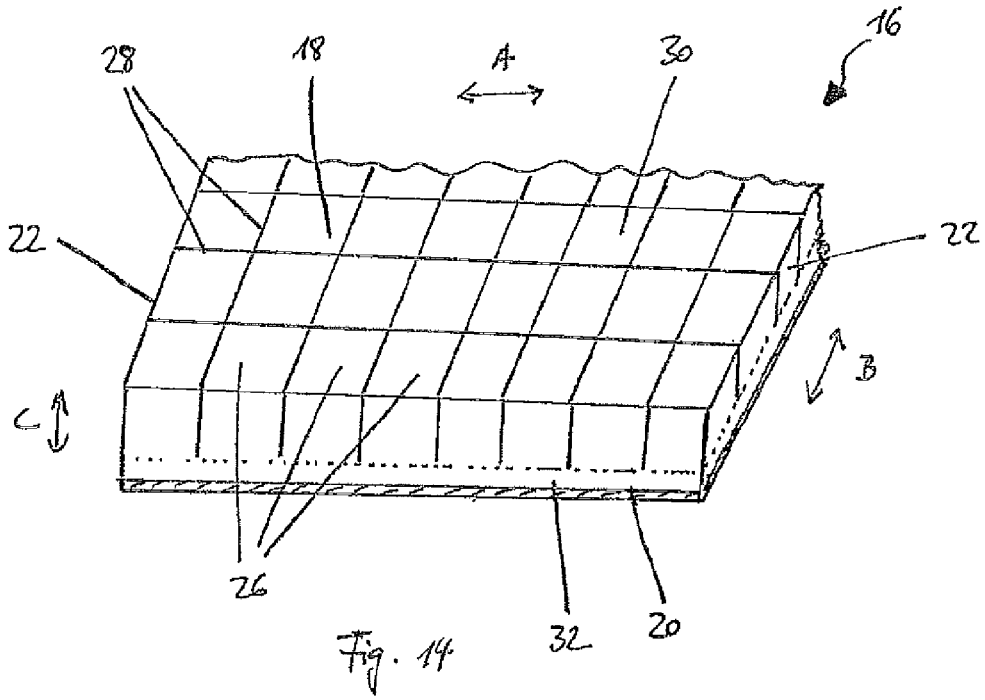
FIG. 14 is a schematic perspective view of a preferred embodiment of a sealing tape for use during window replacement.

FIG. 14 shows an embodiment of sealing tape 16 which is especially suitable for use in the method according to the invention. Because of the purpose which it is intended to serve, sealing tape 16 extends farther in its longitudinal direction (arrow B) than in its transverse direction (arrow A). The transverse direction simultaneously represents the functional direction of sealing tape 16 and extends between two side surfaces 22 of first layer 18. In practice, first layer 18 of the sealing tape is usually precompressed in such a way that, when the pressure on it is released, it can expand preferably to a thickness approximately 5-10 times greater than that which it had in the precompressed state, although, to guarantee reliable contact against masonry 2 and the window frame 24 (FIG. 2*c*, FIG. 15), only about half of this capacity for expansion is actually used in many cases. Arrow C indicates the direction in which compression and expansion occur.

First layer 18 of the sealing tape can be designed as a one-piece foam block, as shown in FIG. 2*a*.

For certain applications, it can be advantageous for sealing tape 16 to comprise several foam segments 26, as shown in FIG. 14. In the present case, these are arranged in rows and columns. Foam segments 26 are formed by cuts 28, i.e., they are separated from each other by cuts 28.

All of cuts 28 extend from the top side 30 into first layer 18 of the sealing tape. When first layer 18 of the sealing tape is in the expanded state, cuts 28 and thus foam segments 26 extend over at least 50% of the height of the layer, preferably up to at least 90% of its height. In the area of the bottom side of first layer 18 of the sealing tape, a web 32 can remain, which connects foam segments 26 to each other. This web 32 is separated in FIG. 14 by a dotted line from foam segments 26 but in reality is an integral part of them.

In the present example, one set of cuts 28 is substantially parallel to side surfaces 22 of first layer 18 of the sealing tape (and thus also, in the expanded state of FIG. 2*a*, parallel to side walls 12 of recess 4), and the other set of cuts 28 is substantially perpendicular to side surfaces 22 of first layer 18 of the sealing tape (and thus also, in the expanded state of FIG. 2*a*, perpendicular to side walls 12 of recess 4), as a result of which foam segments 26 acquire a rectangular outline. When seen from above, foam segments 26 thus form a checkerboard pattern. In this way, each of a majority of foam segments 26, i.e., all of foam segments 26 except those located at the edge of sealing tape 16, is completely surrounded in the longitudinal direction B and in the transverse direction A of sealing tape 16 by other foam segments 26.

In addition to the design and direction of cuts 28 shown here, many other designs are also conceivable. For example, cuts 28 can extend at an angle or in zigzag fashion through sealing tape 16; they could also be wave-like or have any other desired, preferably regular, configuration. Accordingly, the shape of the individual foam segments 26 can also deviate from the block-like shape shown in FIG. 14. For example, foam segments 26 can be given a rhombic outline. Cuts 28 can also extend at an angle from top to bottom. Nearly any 3-dimensional design of foam segments 26 is possible.

Cuts 28 are usually extremely narrow, and they are produced by displacement cutting, i.e., a form of cutting which does not result in the loss of any material when cuts 28 are made in foam strip 18. It is also possible to produce cuts 28 by punching foam material out of strip 18, if this is deemed advantageous for certain applications. As a rule, however, it is preferable to make cuts 28 as narrow as possible and to lose as little material as possible when making cuts 28, so that the sealing action of sealing tape 16 remains as strong as possible.

Figure 15:
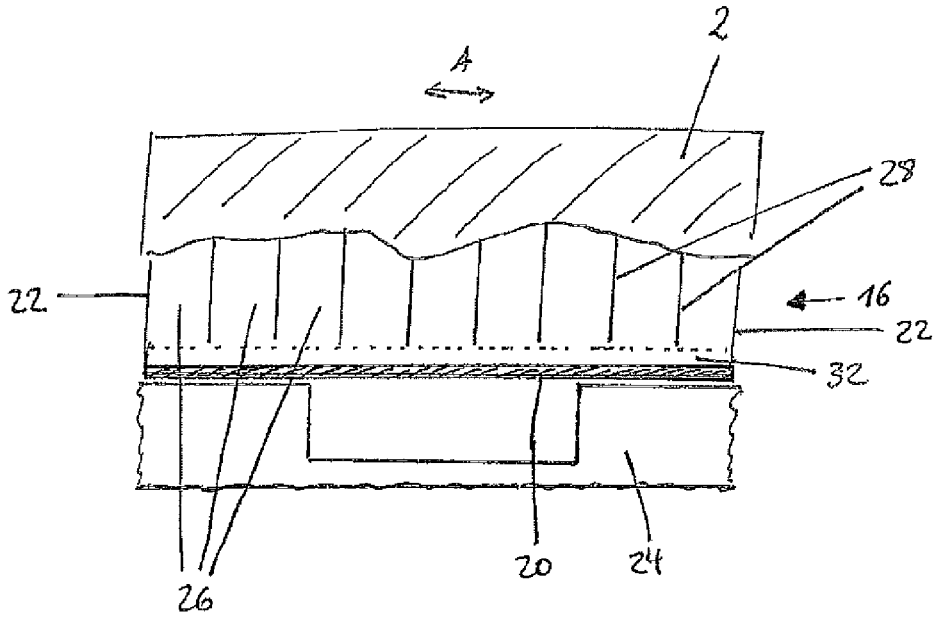
FIG. 15 is a schematic cross-sectional view of the sealing tape of FIG. 14 after installation in a recess to be sealed.

FIG. 15 shows schematically the installed state of sealing tape 16 of FIG. 14. It can be seen how even major irregularities in masonry 2 can be compensated by sealing tape 16 as a result of the ability of the individual foam segments 26 to expand independently of each other, thus ensuring that foam segments 26 make good contact with bottom 10 of recess 4 and produce a reliable seal.

Cuts 28 could also extend over the entire height of first layer 18 of the sealing tape, so that the individual foam segments 26 are connected to each other only by second layer 20.

As can be seen from FIG. 2*a*, sealing tape 16 is introduced into the channel-shaped recess 4 with first layer 18 facing forward. In other words, first layer 18 of the sealing tape is oriented toward bottom 10 of recess 4. In the inserted state, first layer 18 of the sealing tape is at least partially compressed. As much as possible of the surface of top side 30 of first layer 18 of the sealing tape rests against bottom 10 of recess 4. In the example shown here, the width of sealing tape 16 corresponds approximately to the width of recess 4, but it is also possible for the first layer of sealing tape 16 to be narrower than recess 4. It is also conceivable that sealing tape 16 could be, within certain limits, wider than recess 4 and thus be somewhat compressed in the width direction after the sealing tape has been fitted into recess 4. In the example shown here, the space between two side walls 12 of recess 4 is completely filled by sealing tape 16.

Second layer 20 of the sealing tape in the variant shown here has also been introduced through open access section 14 of the recess and has clamped itself against side walls 12 of recess 4. As a result, the expansion of the partially compressed first layer 18 of the sealing tape in recess 4 is at least temporarily limited in the direction toward open access section 14. Clamped second layer 20 of the sealing tape thus at least temporarily prevents first layer 18 from expanding further.

As can be seen in FIG. 2*b*, window frame 24 is now placed in the area of recess 4 filled by sealing tape 16 while the expansion of first layer 18 of the sealing tape is still being at least temporarily limited. Because new window frames 24 are usually somewhat wider than old window frames, new window frame 24 projects somewhat beyond both sides of recess 4. The invention can still be used even when this is not the case, however. Window frame 24 is usually placed in such a way that a planned gap of at least 5 mm remains on all sides between it and masonry 2. After window frame 24 has been aligned in the window opening, it is fastened to masonry 2 by means of screws (not shown), for example.

After a certain period of time, the clamping action of second layer 20 against side walls 12 of recess 4 yields to the expansion pressure of first layer 18, so that second layer 20 is slowly pushed along side walls 12. Sealing tape 16 thus expands more and more toward window frame 24 until it finally rests against window frame 24. In this final installation state, first layer 18 of the sealing tape still has a certain expansive force, so that a reliable seal is ensured both in the direction toward window frame 24 and also in the direction toward bottom 10 of recess 4. Additional sealing elements 34 or sealants can also be inserted or injected between window frame 24 and masonry wall 2 on one or both sides of sealing tape 16. Alternatively, the still visible joint between masonry 2 and window frame 24 can be covered by a strip of plastic, for example.

To ensure the defined expansion of the sealing tape at the desired time, a flat, angled tool can be inserted between side wall 12 of recess 4 and second layer 20 and then used to lever second layer 20 upward along its edge.

Figure 3:
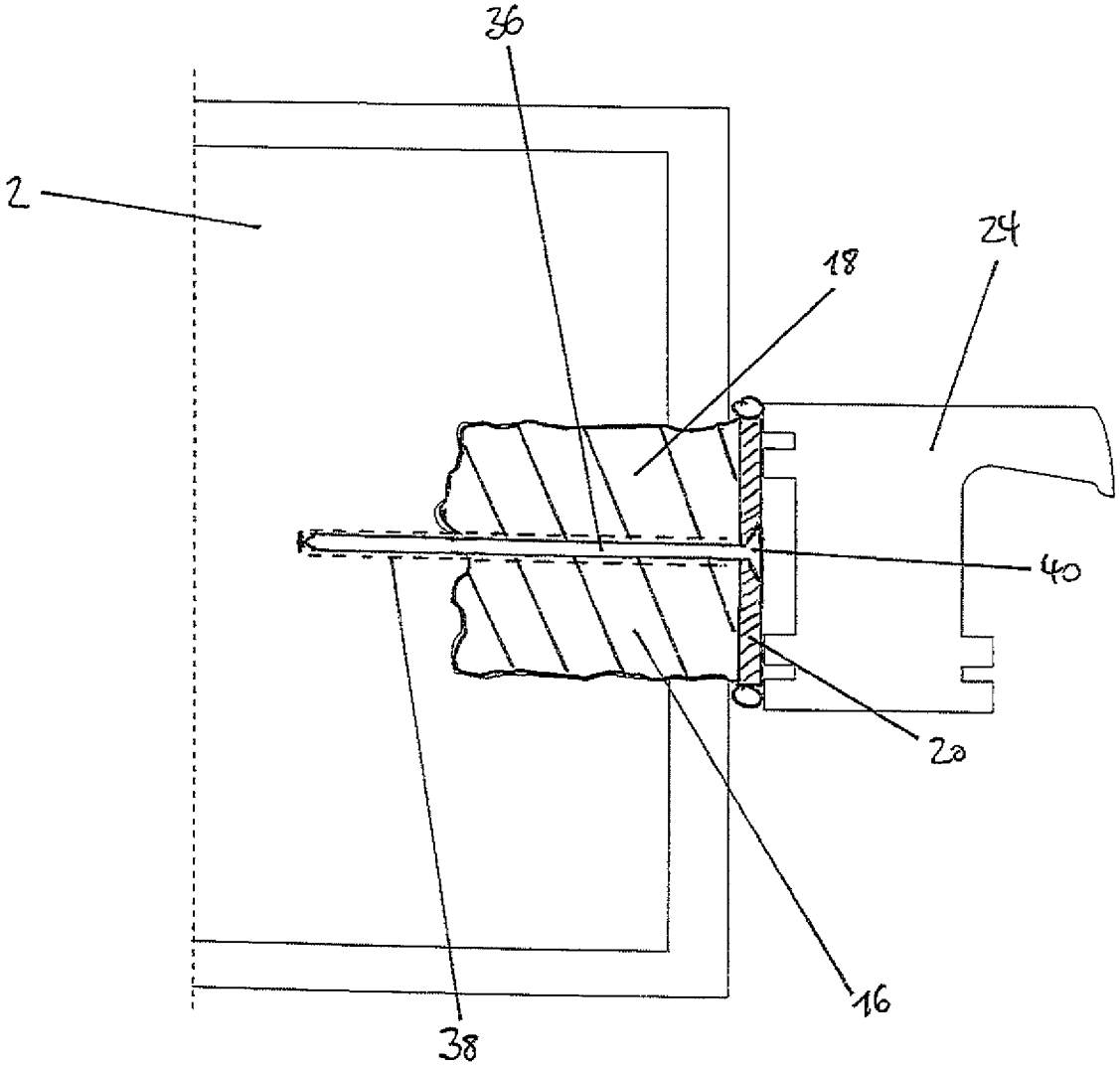
FIG. 3 is a cross-sectional view of the masonry wall of FIG. 1 with an installed window frame and an alternative design of the sealing arrangement.

In the variants shown in FIG. 3, sealing tape 16 is held in the desired final position from the very beginning This is done by the use of retaining elements in the form of screws 36 or nails, which are driven through the sealing tape and anchored in bottom 10 (or alternatively in side walls 12) of recess 4. When screws 36 are used, it is first necessary to produce appropriate pilot holes 38. This can be done by means of a conventional drill preferably after sealing tape 16 has been fitted into recess 4. Then screws 36 are screwed into pilot holes 38. The heads 40 of screws 36 or nails exert a retaining function on second layer 20 of the sealing tape and thus define the maximum extent to which sealing tape 16 can expand. In other words, heads 40 of screws 36 or nails prevent sealing tape 16 from expanding any further. Heads 40 of screws 36 or nails are preferably of the countersunk type and thus penetrate into second layer 20 of the sealing tape, so that a flat surface is obtained and window frame 24 encounters no obstacles as it is being installed. Screws 36 or nails and thus sealing tape 16 will project slightly out of recess 4, so that a seal is achieved between window frame 24 and sealing tape 16 after window frame 24 has been inserted.

Figure 4:
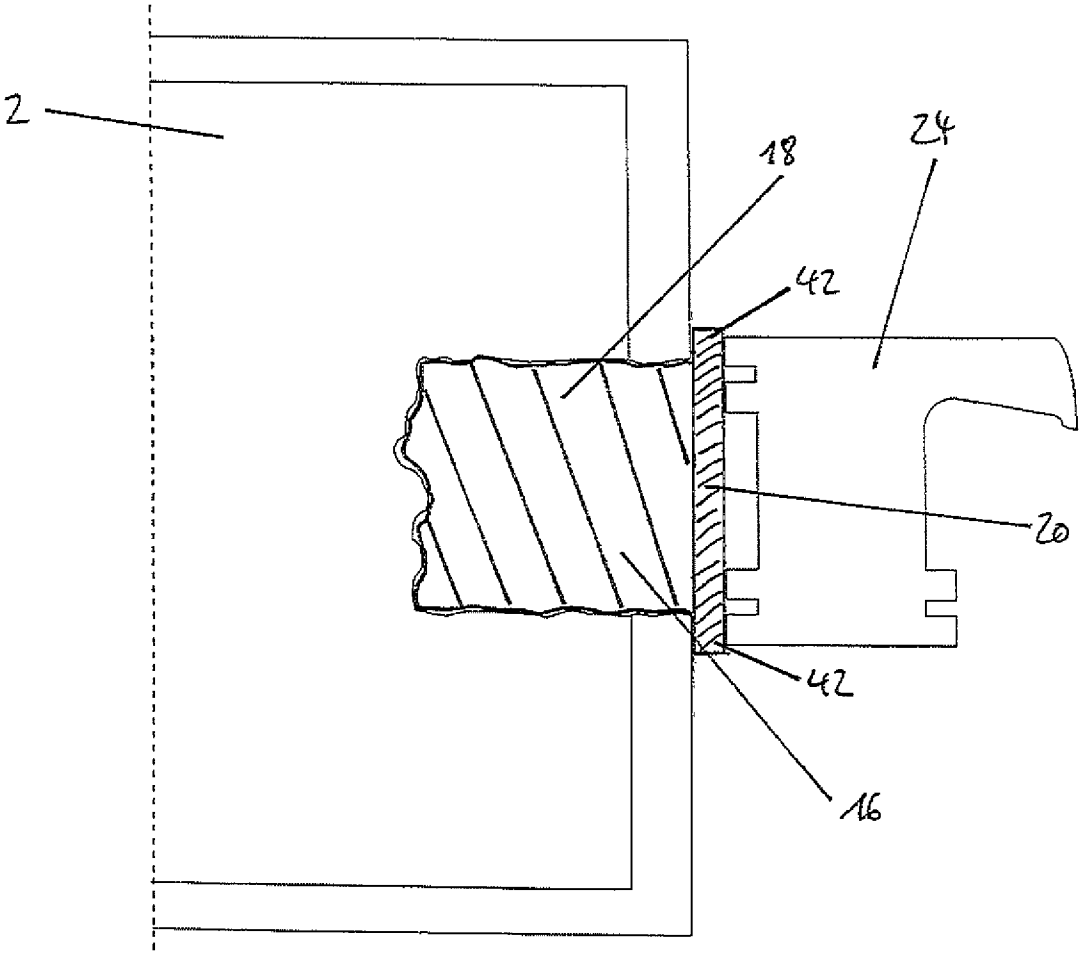
FIG. 4 is a cross-sectional view of the masonry wall of FIG. 1 with an installed window frame and another alternative design of the sealing arrangement.

FIG. 4 shows an alternative design of sealing tape 16, which can be combined with any of the other variants described here. In this embodiment, second layer 20 of the sealing tape comprises two clamping sections 42 extending laterally beyond first layer 18 of the sealing tape to improve the clamping action of second layer 20 against side walls 12 of recess 4. This not only supports the clamping force of second layer 20 in recess 4 in the state shown in FIG. 2*a* but also makes it possible for sealing tape 16 to rest against the edges of window frame 24 in the final installation state shown in FIG. 4.

Figure 5:
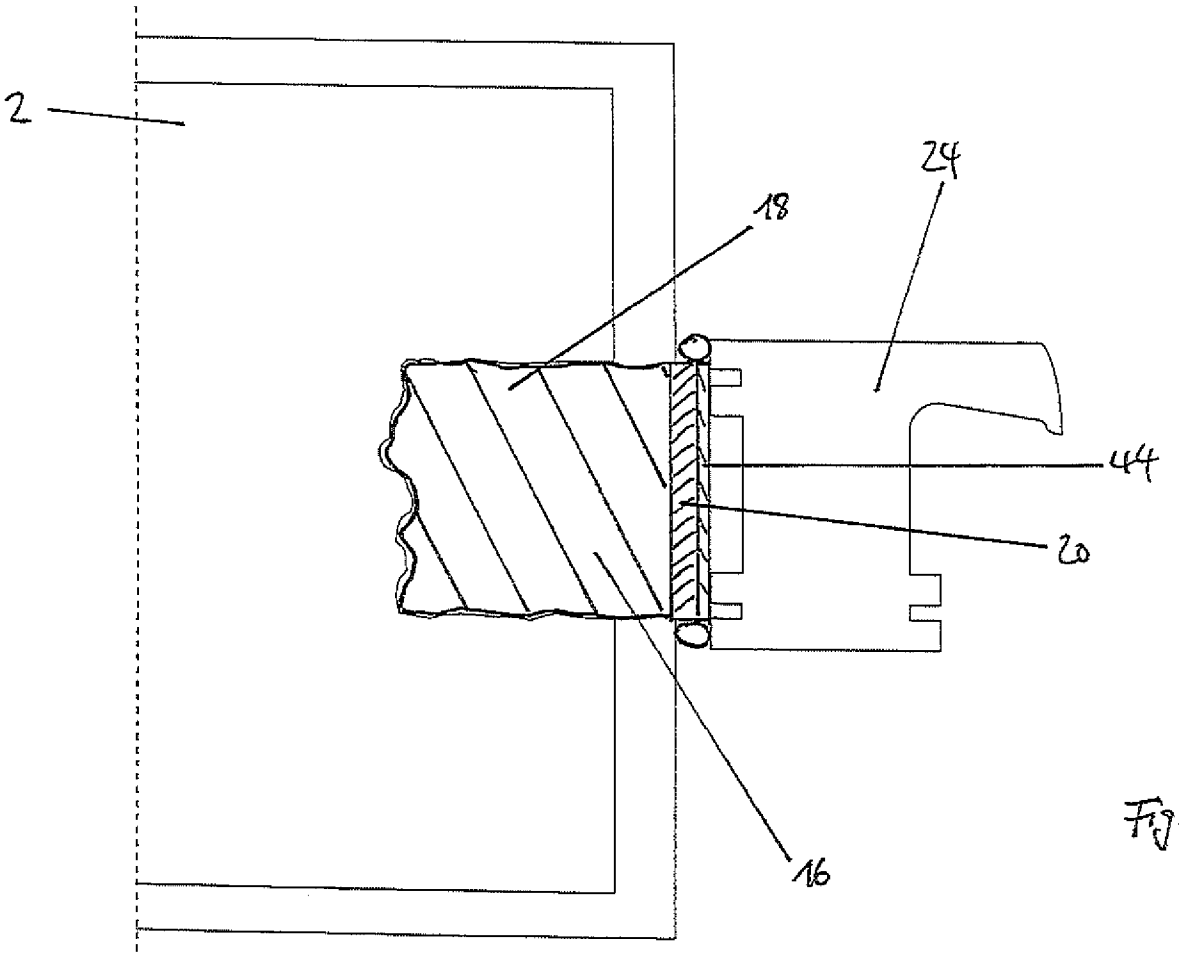
FIG. 5 is a cross-sectional view of the masonry wall of FIG. 1 with an installed window frame and another alternative design of the sealing arrangement.

FIG. 5 shows another alternative embodiment of sealing tape 16, which again can be combined with any of the other variants. As a supplement to the embodiment of sealing tape 16 shown in FIG. 2*a*, sealing tape 16 here comprises a third layer 44 of flexible foam, which is permanently bonded to second layer 20 on the side of second layer 20 opposite first layer 18. This is done preferably by means of an adhesive or by lamination. Third layer 44 is relatively thin (preferably in the range of 1-10 mm) and serves to improve the sealing action against window frame 24.

FIGS. 6*a*-6*e* show another preferred variant of the method according to the invention. First, sealing tape 16 is again fitted into recess 4. Then flat retaining strips 46 are attached as retaining elements over the open access section 14 of recess 4 to exert a retaining function on second layer 20 of the sealing tape and thus temporarily to prevent first layer 18 of the sealing tape from expanding further. Flat retaining strips 46 can be made of, for example, wood, metal, or plastic, and they comprise a thickness in the range of 0.5-5 mm. After sealing tape 16 has been fitted into recess 4, flat retaining strips 46 in the example shown here are anchored by means of screws 48 or nails in bottom 10 of recess 4 (or alternatively on the left and right of the recess, near side walls 12). When screws 48 are used, it is necessary again to produce pilot holes 50 in masonry 2, wherein, in a preferred embodiment, sealing tape 16 has already been provided with appropriate through-openings at these points. Screws 48 or nails are screwed into bottom 10 of recess 4 until their heads 52 press against flat retaining strips 46, and after retaining strips 46 have been installed, two side sections 54 of flat retaining strips 46 rest against masonry 2, one on each side of recess 4. In this way, flat retaining strips 46 exert a retaining function on second layer 20 of sealing tape 16, which presses against retaining strips 46. Flat retaining strips 46 can be placed on sealing tape 16 even before screws 48 or nails are introduced, or they can be inserted locally between second layer 20 of the sealing tape and heads 52 of screws 48 after screws 48 have been screwed in. In the installed state, therefore, heads 52 of screws 48 or nails project slightly outward from second layer 20 of sealing tape 16, namely, by a distance which is defined by the thickness of retaining strips 46.

Figure 6A:
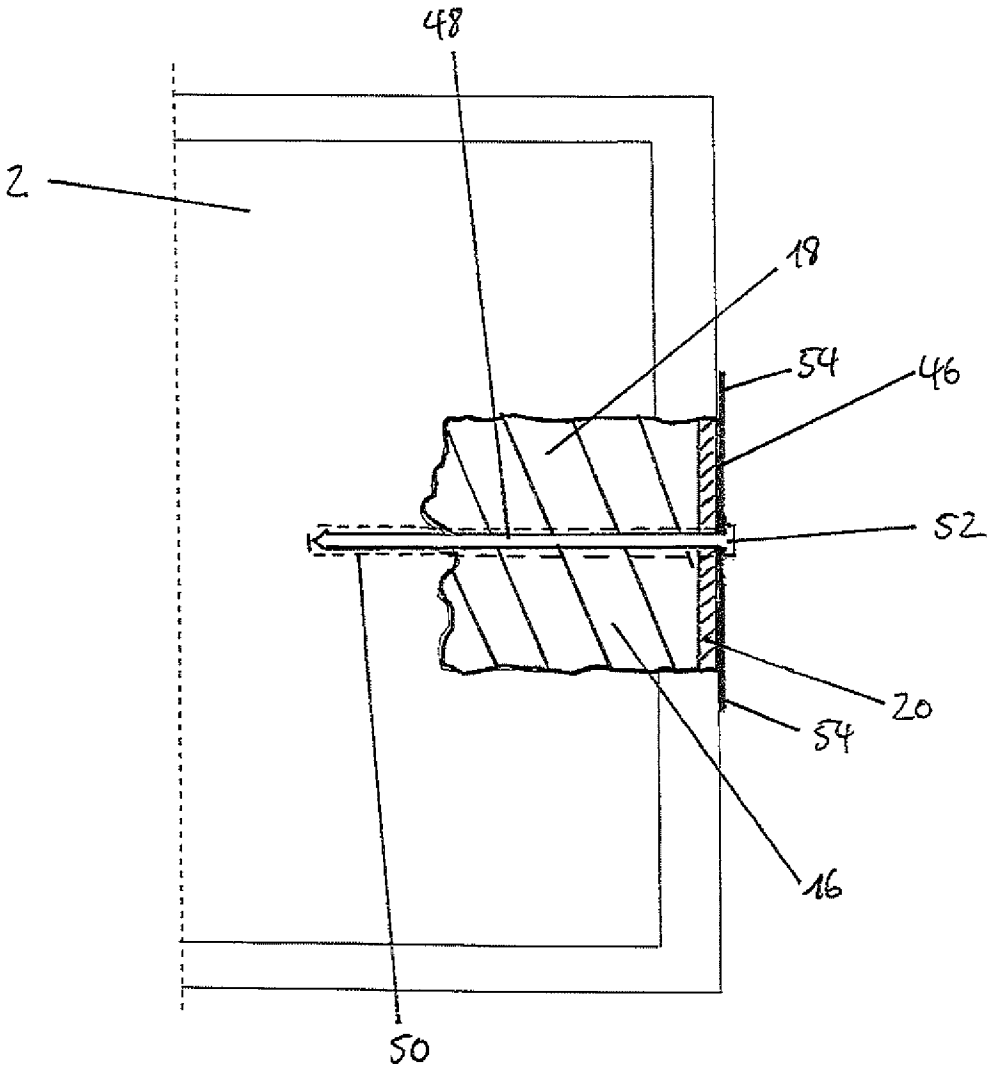
Figure 6A:
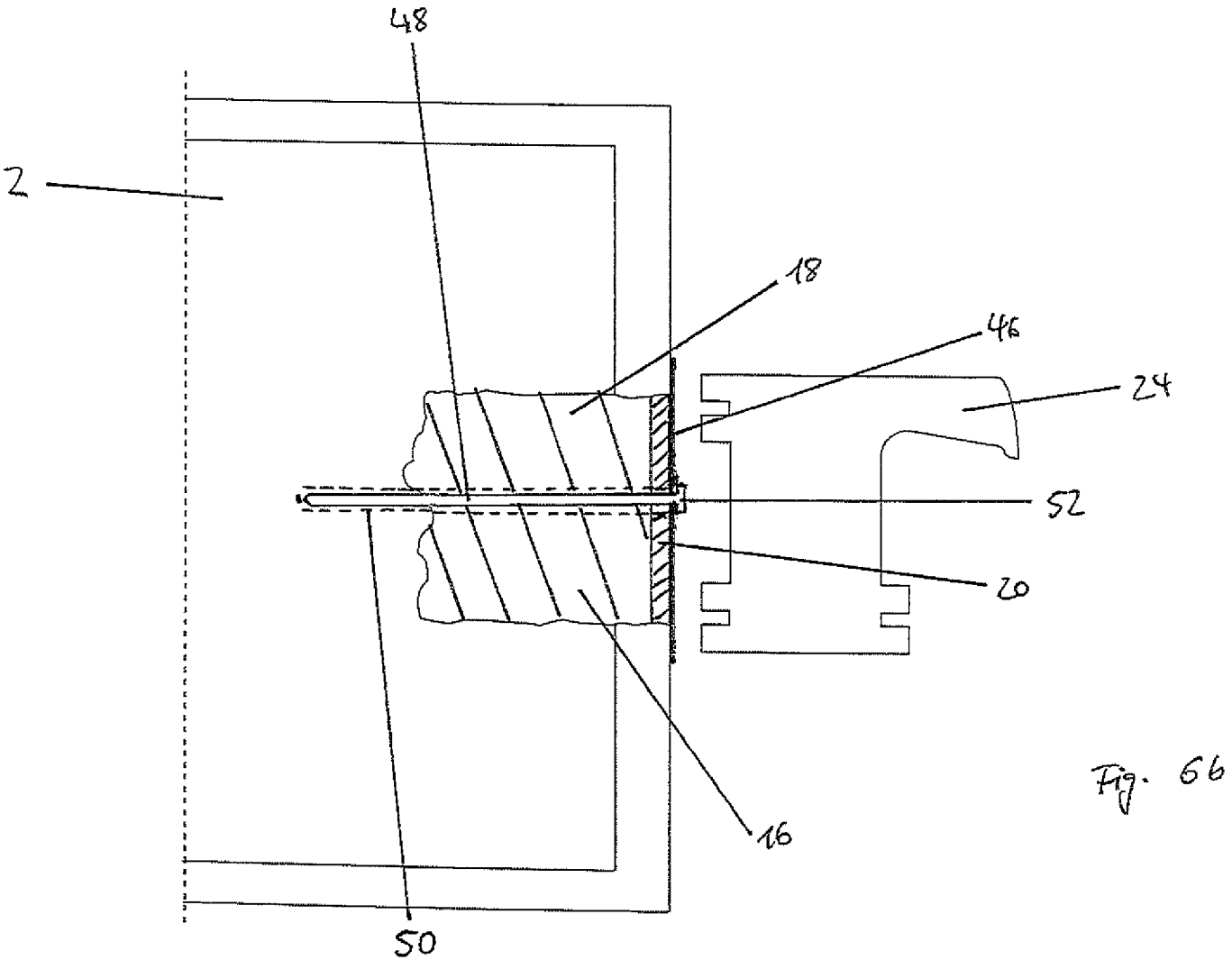
Figure 6C:
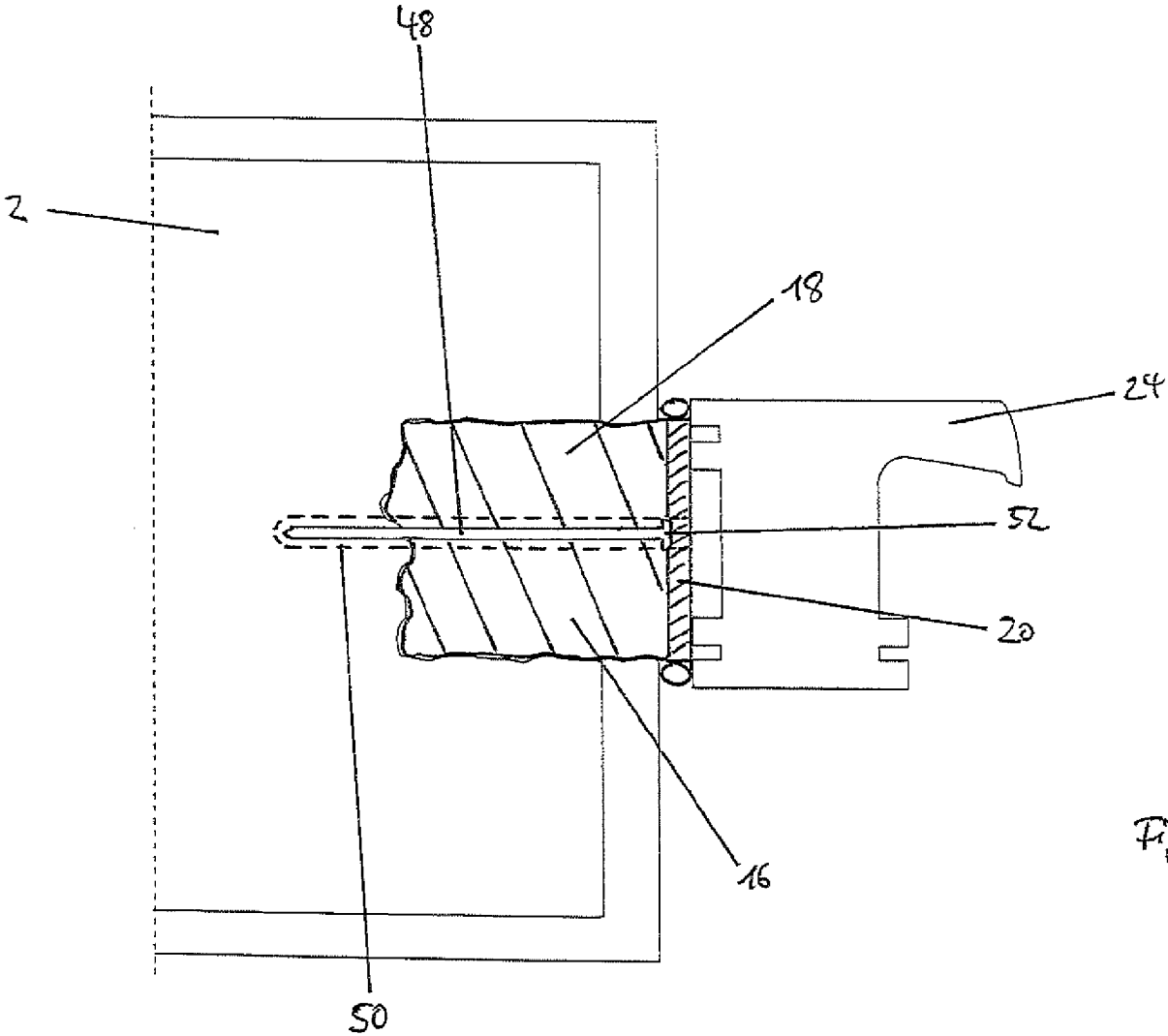
Figure 6D:
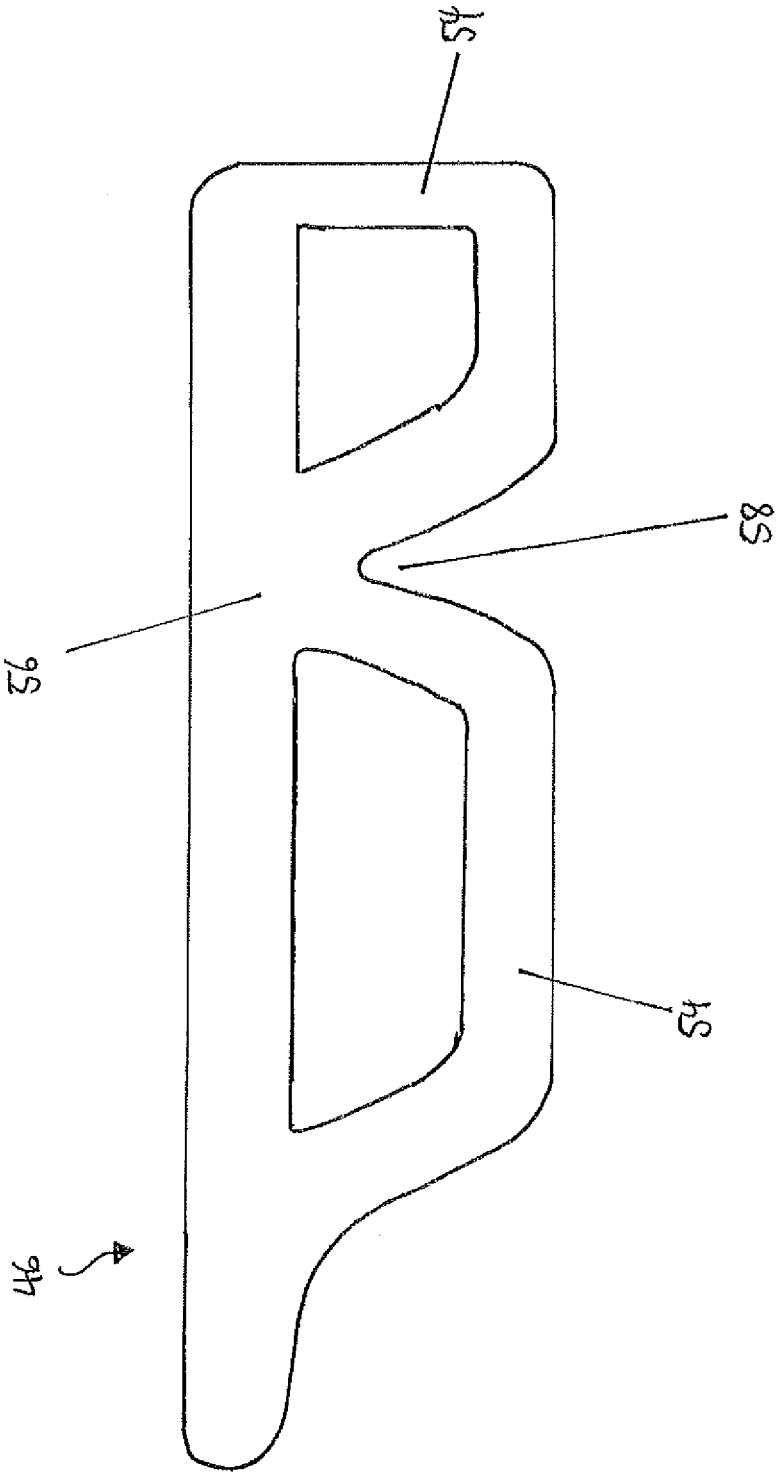
FIG. 6*d* is a top view of an embodiment of a retaining strip of the type which can be used in the method according to FIGS. 6*a*-6*c;*
Figure 6E:
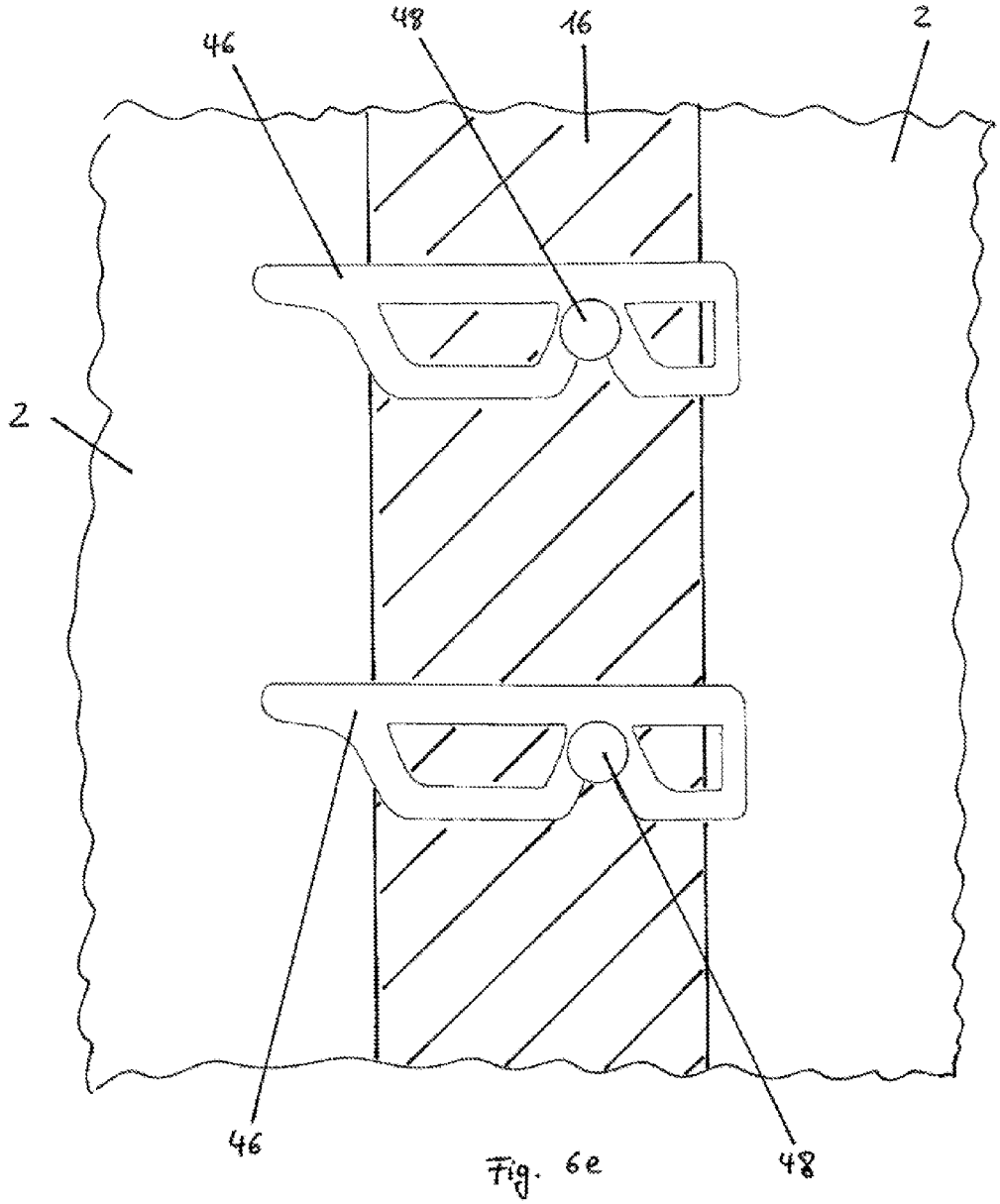
FIG. 6*e* is a top view of the masonry wall in the step of the sealing process according to FIG. 6*a*.

FIG. 6*d* shows by way of example an embodiment of retaining strip 46. The middle section 56, which is located between the two side sections 54, serves here, after installation of retaining strips 46, to rest against heads 52 of screws 48 or nails from underneath. In the preferred embodiment shown here, flat retaining strip 46 comprises in its middle section 56 an opening 58, which serves to accept the shaft of screws 48 or nails. Opening 58 is preferably open to the side and expands toward the outside. After window frame 24 has been put in place (see FIG. 5*b*), retaining strips 46 can thus be easily loosened by sliding them sideways away from screws 48 and then removed from the window structure. Removing retaining strip 46 has the effect of the releasing the retaining function being exerted on sealing tape 16, and the force of expansion of first layer 18 of the sealing tape causes sealing tape 16 to make contact with window frame 24. The important point here is that heads 52 of screws 48 or nails can be countersunk into sealing tape 16 or sealing tape 16 can expand around heads 52 of screws 48 or nails in the direction toward window frame 24. This process is made especially easy by providing prefabricated through-openings in sealing tape 16 which are at least as large as heads 52 of screws 48. It is also possible for heads 52 of screws 48 being used to have the same diameter as the shaft of screws 48, although they must be separated from the shaft by a notch. In this case, retaining strip 46 is held in the notch. The person skilled in the art will be able to come up with many other modifications in this area.

Especially the number and shape of retaining strips 46 can be varied in many different ways. The distances between individual retaining strips 46 also depend on the expansive force of sealing tape 16 and can be varied.

FIGS. 7*a* and 7*b* show another way in which sealing tape 16 can be held temporarily in place in recess 4. For this purpose, retaining elements in the form of retaining clips 60 are used, which are shown in greater detail in FIG. 7*b*. Retaining clips 60 can be in the form of the letter "T", for example, the shaft 62 of which is inserted into an intermediate space between sealing tape 16 and side wall 12 of recess 4, whereas the top section 64 rests against second layer 20 of the sealing tape and against adjacent masonry 2 and thus serves a retaining function on second layer 20 of the sealing tape. To improve the anchoring of shaft 62 against side walls 12 of the recess and against sealing tape 16, laterally projecting barbs 66 can be provided on shaft 62.

The retaining function is released in this case by, for example, breaking off the head sections 64 or by turning head sections 64 by 90° so that head sections 64 become oriented parallel to the intermediate space between sealing tape 16 and side wall 12 of recess 4 and thus no longer prevent sealing tape 16 from expanding.

Many other embodiments of retaining clips 60 are possible. These can also be fastened permanently to masonry 2 by the use of screws, for example. They could also cover the entire sealing tape 16.

Figure 8:
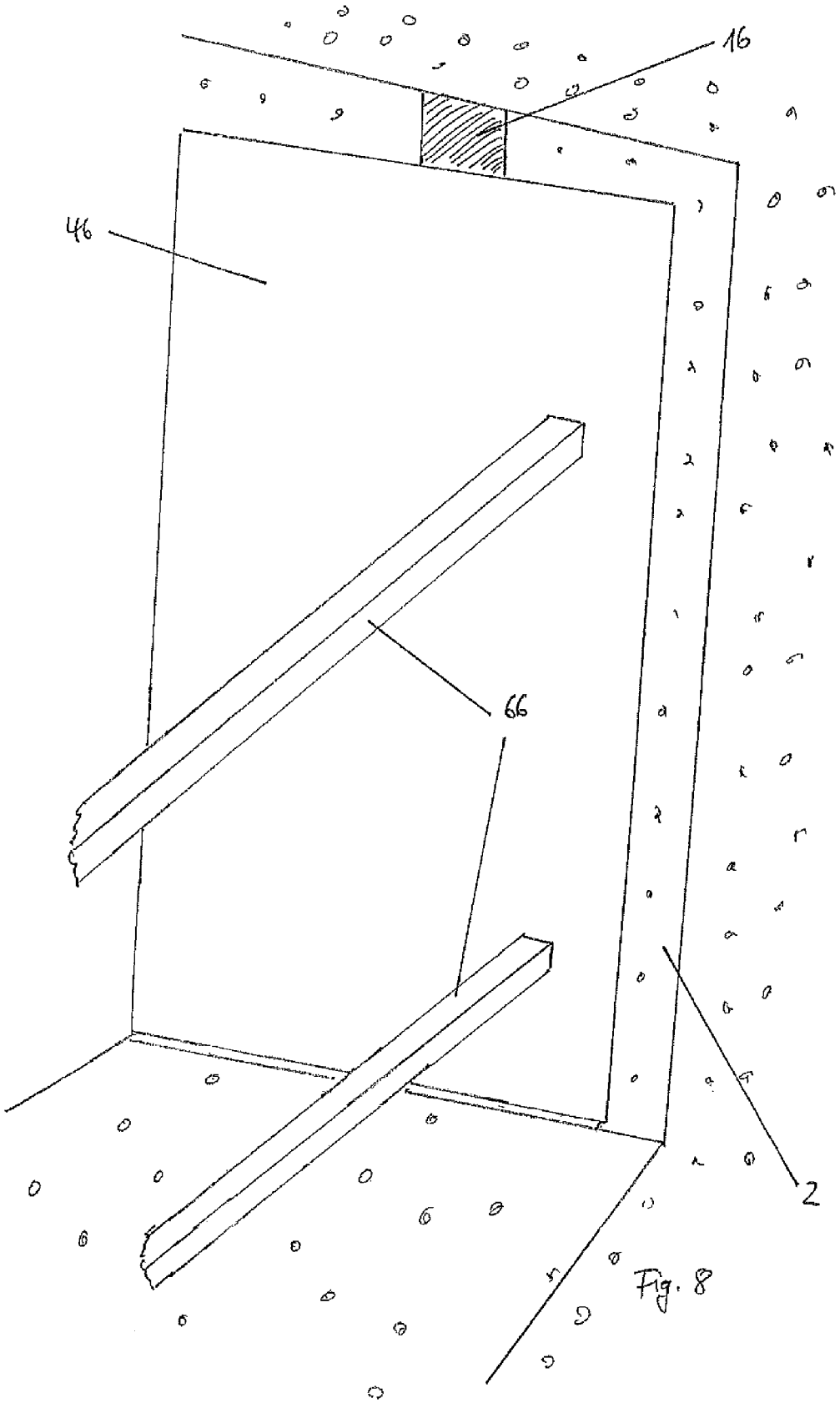
FIG. 8 is a perspective view of a masonry opening, into which a window frame is to be installed, with a sealing tape fitted into a channel-shaped recess and a retaining frame for retaining the sealing tape in the recess.

FIG. 8 shows another embodiment of a flat retaining strip 46 serving as a retaining element. This strip is part of an all-over retaining casing, which is inserted into the window opening either as a whole or as individual segments to be connected to each other before window frame 24 is inserted and serves to hold sealing tape 16 in recess 4. In this case, it is advantageous for the retaining casing to comprise at least two opposing retaining strips 46, which are connected to each other by transverse struts 66. These transverse struts 66 are preferably length-adjustable, so that they can be adapted to window openings of different sizes. After window frame 24 has been put in place, the retaining casing can be removed, and sealing tape 16 will expand against installed window frame 24 and seal it off.

As a rule, the retaining casing will have to have at least three retaining strips 46 connected to each other like the arch of a door in order to cover the left side, the right side, and the top of the window opening.

Figure 9:
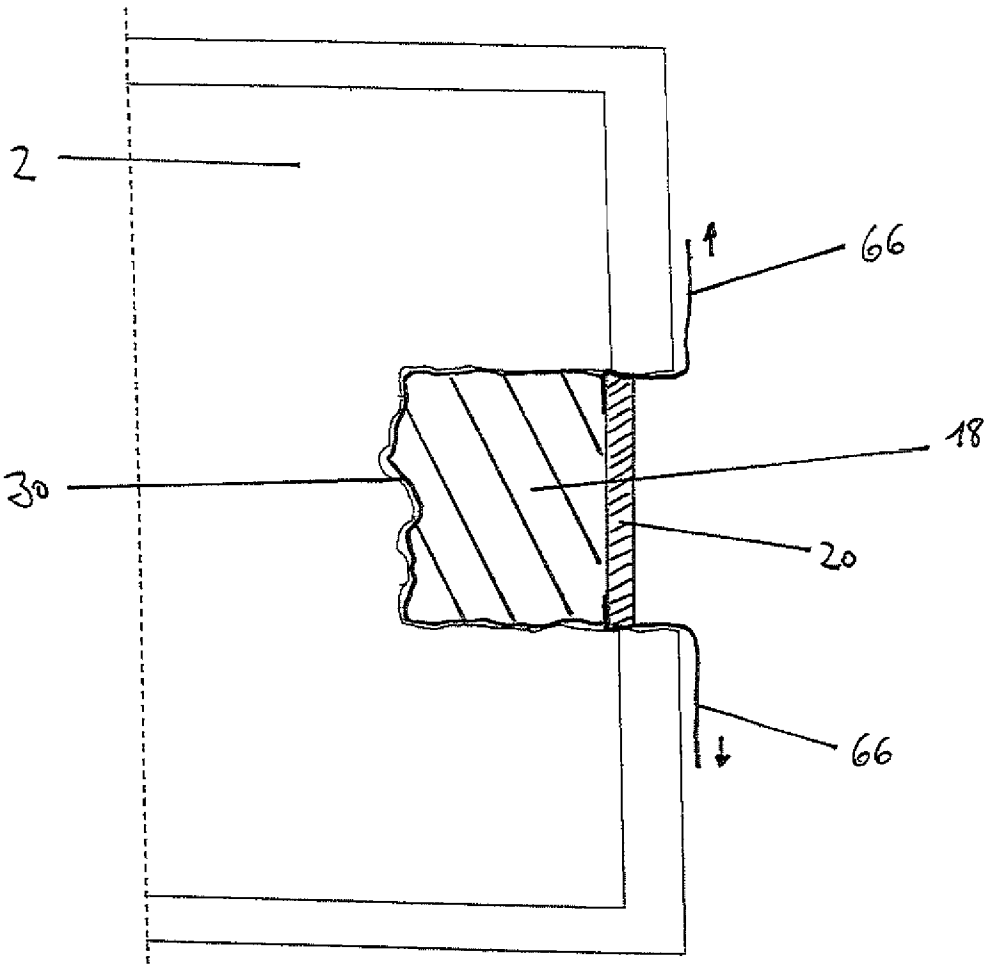
FIG. 9 is a cross-sectional view of the masonry wall of FIG. 1 with another alternative possibility for retaining the sealing tape.

FIG. 9 shows another alternative possibility for temporarily preventing the expansion of sealing tape 16 and for defining the time at which first layer 18 of sealing tape 16 starts to expand. The embodiment of sealing tape 16 corresponds here essentially to the embodiment of FIG. 2*a*, and the temporary retention of sealing tape 16 in recess 4 is achieved here by the clamping of second layer 20 against side walls 12. So that the clamping effect can be released when desired, at least one laterally projecting pull element is provided, here in the form of a sheet-like pull tab 66, which transmits a force to second layer 20 in the direction toward the open access section 14. In the example shown here, two pull tabs 66 are provided, but it is also possible to provide only a single pull tab 66 on one side.

Pull tab 66 is permanently bonded to second layer 20 of sealing tape 16, preferably by an adhesive or by lamination. In the example shown here, pull tab 66 is guided laterally under second layer 20 and attached there to the bottom edge. Pull tab 66 could also be attached to the side or to the top of second layer 20.

The deliberate release of the retaining function is achieved now by pulling the at least one pull tab 66, as a result of which a section of second layer 20 or entire second layer 20 is raised toward the open access section 14. Thus the clamping action of second layer 20 against side walls 12 of recess 4 is released, and the attempt by first layer 18 of sealing tape 16 to expand is no longer restrained at all or at least no longer significantly restrained.

The term "sheet-like" includes, for example, any tear-resistant sheet-like material, mesh material, laminated material made of plastic sheets laminated to a backing (e.g., nonwoven material), and fabric-reinforced sheets. Combinations of these materials are also possible.

In the case of FIG. 9, in which two pull tabs 66 are provided, one on each of the two opposite sides of sealing tape 16, both pull tabs 66 are preferably pulled simultaneously in opposite directions as indicated by the arrows in order to raise second layer 20 toward open access section 14.

If pull tab 66 is attached to the top of second layer 20, it is advantageous to design it as an integral part of that layer and to provide it with two pull sections, one projecting to each of the two sides, which can be pulled simultaneously in opposite directions in order to raise the second layer toward open access section 14.

Figure 10:
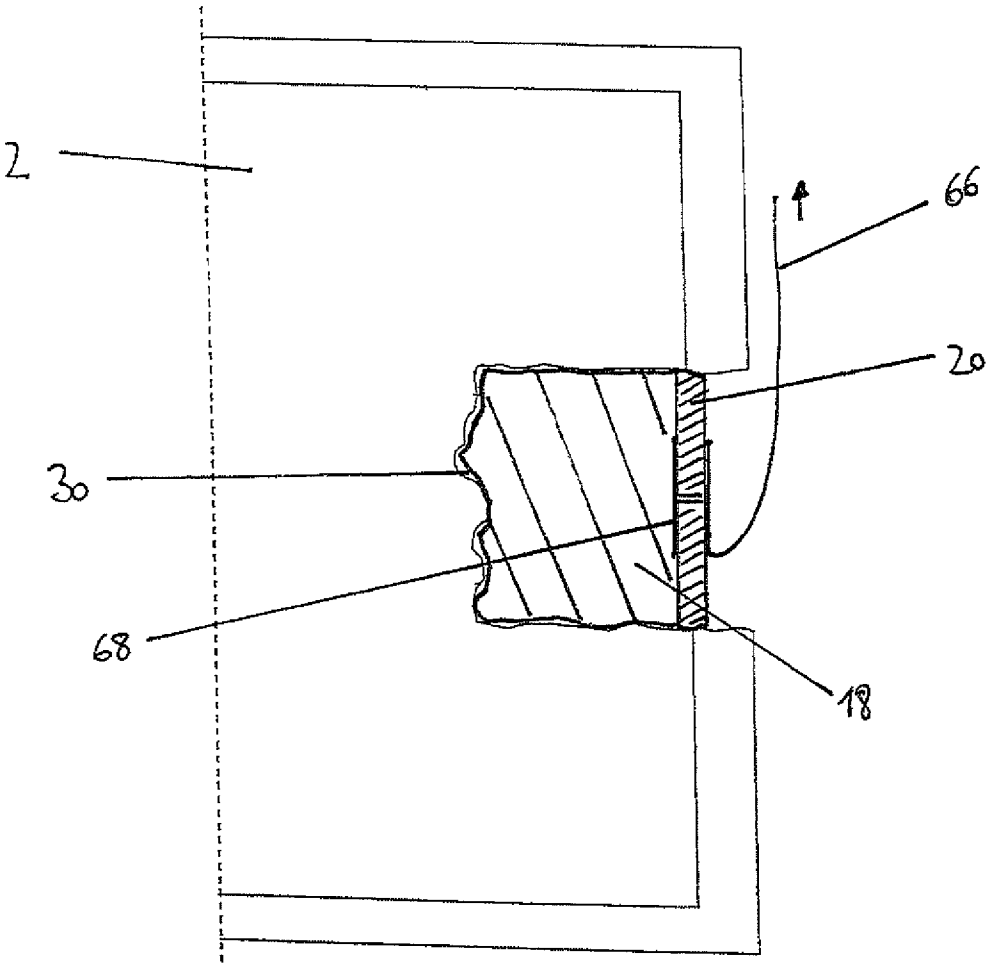
FIG. 10 is a cross-sectional view of the masonry wall of FIG. 1 with another alternative possibility for retaining the sealing tape.

FIG. 10 shows a variation of the embodiment of FIG. 9. Here, too, a pull tab 66 is provided as a pull element, which is attached to the top of second layer 20. Here, however, second layer 20 is designed in two sections with a gap between the two sections. Pull tab 66 is attached on both the right side and the left side of the gap. If desired, adhesive tape 68 can be fastened over the gap on the opposite side of second layer 20. Pull tab 66 is preferably guided here to one side of recess 4 so that it has the shape of a "U". Pulling pull tab 66 raises the middle part of second layer 20 toward access section 14. The two sections of second layer 20 thus acquire an inverted "V" shape, and the clamping of second layer 20 against side walls 12 of recess 4 is released. The adhesive tape 68 can serve to hold the two sections of second layer 20 together.

In the embodiments according to FIGS. 9 and 10, pull tab 66 can be an element designed to extend continuously in the longitudinal direction of recess 4, but it is also possible to arrange several narrow pull elements spaced a certain distance apart in the longitudinal direction of the recess 4. In this case, cords of tear-resistant material, for example, can be used as pull elements.

Figure 11:
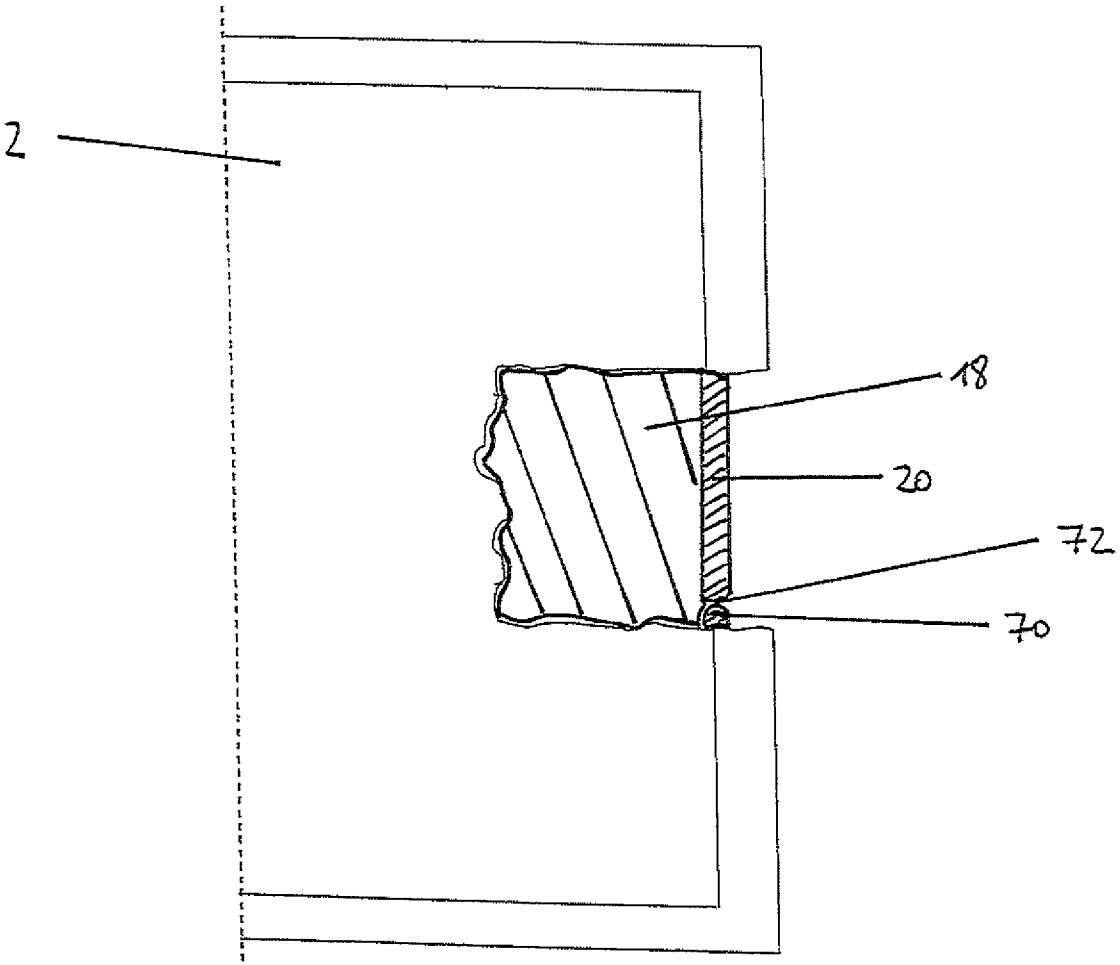
FIG. 11 is a cross-sectional view of the masonry of FIG. 1 with another alternative possibility for retaining the sealing tape.

FIG. 11 shows another alternative possibility for temporarily preventing the expansion of sealing tape 16 and for defining the time at which first layer 18 of sealing tape 16 starts to expand. In this example as well, second layer 20 is clamped against side walls 12 of recess 4. Second layer 20, however, comprises a narrow edge section 70, which is connected detachably to the rest of second layer 20 by a perforation 72 or a thin area. This edge section 70 can extend beyond sealing tape 16 along one long side of recess 4, and the extension can thus serve as a pull section. By pulling edge section 70, edge section 70 is separated at perforation 72 or thin area from the rest of second layer 20, and thus the clamping action of second layer 20 against side walls 12 of recess 4 is released.

Figure 12:
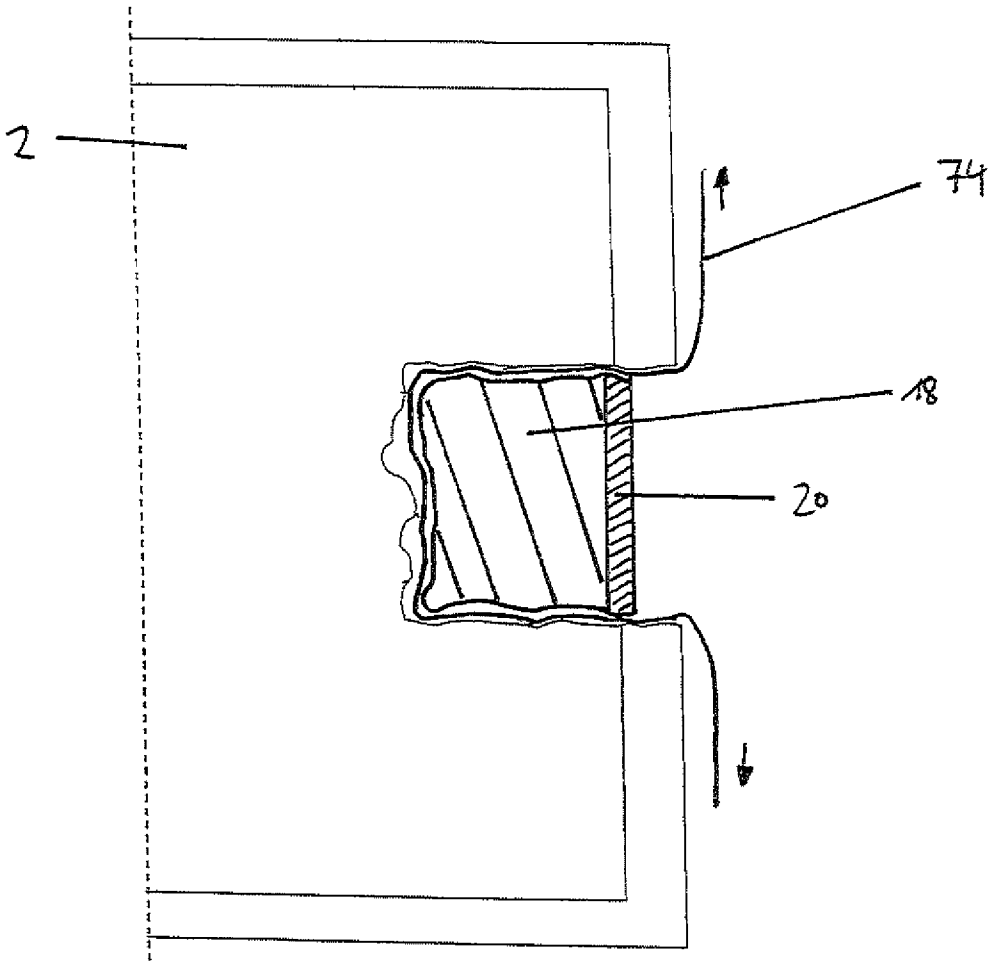
FIG. 12 is a cross-sectional view of the masonry of FIG. 1 with another alternative possibility for retaining the sealing tape.

FIG. 12 shows an embodiment similar to that of FIG. 9. The pull element, however, is designed here as a thin, one-piece strip 74 extending in the longitudinal direction of recess 4. This strip is laid in recess 4 before sealing tape 16 is inserted, wherein pull sections of strip 74 project from both sides of recess 4. In this case, second layer 20 is not clamped directly against side walls 12 of recess 4 but rather indirectly by way of strip 74.

To release the clamping action when desired, it is necessary merely to pull on the two pull sections of thin strip 74 simultaneously in opposite directions. As a result, first layer 18 of sealing tape 16 is compressed, and then second layer 20 is raised toward open access section 14. After thin strip 74 has been removed by pulling it out laterally, first layer 18 of sealing tape 16 can expand again toward bottom 10 of recess 4.

The same materials as those suitable for pull tab 66 can be used for thin strip 74. In this case as well, it is also possible to arrange, instead of thin strip 74, several narrow pull elements spaced a certain distance apart in the longitudinal direction of recess 4, which can be designed as cords, for example.

Figure 13:
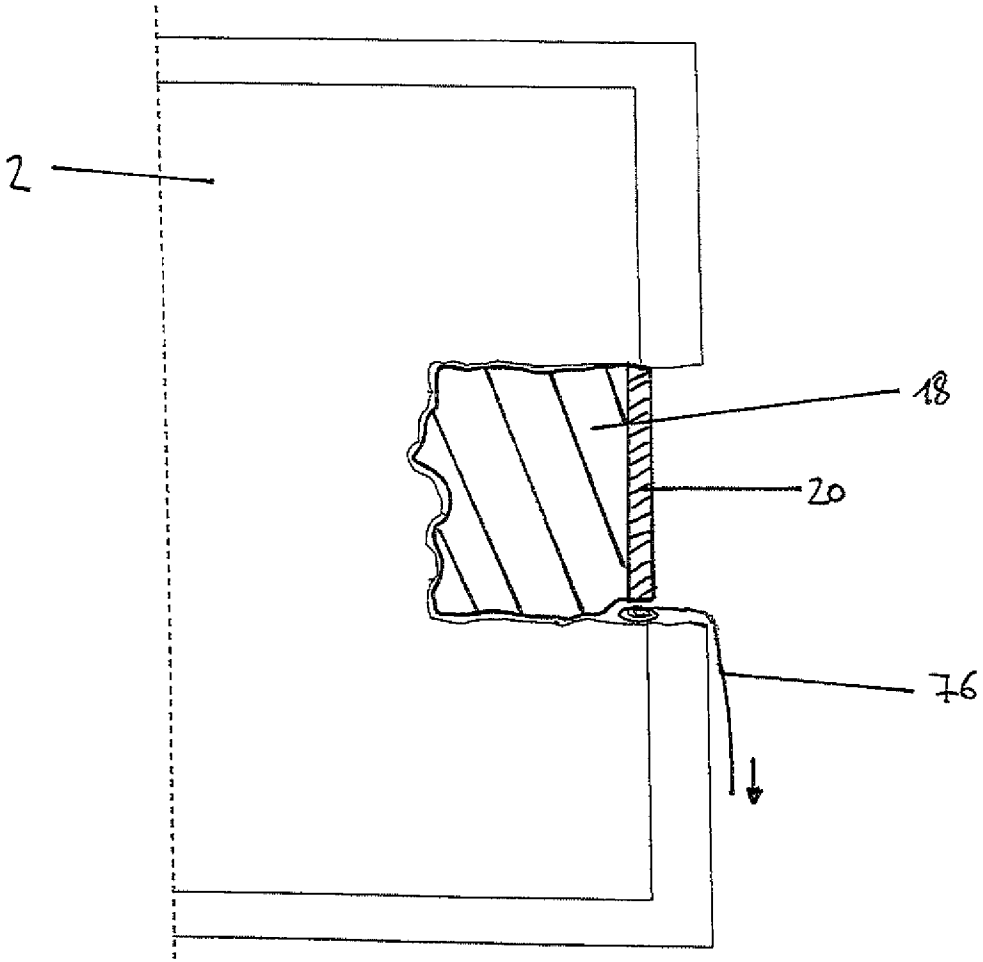
FIG. 13 is a cross-sectional view of the masonry of FIG. 1 with another alternative possibility for retaining the sealing tape.

FIG. 13 shows another alternative possibility for temporarily preventing sealing tape 16 from expanding and for determining the time at which first layer 18 of sealing tape 16 starts to expand. Here second layer 20 is narrower than recess 4, and a clamping aid member 76 is provided to clamp second layer 20 in recess 4 in the area of at least one lateral surface 22 of second layer 20. This clamping aid member 76 bridges the gap between second layer 20 and side wall 12. Clamping aid member 76 can be designed, as illustrated, as a roll of sealing tape such as a tape of plastic foam, but it is also possible to use any other type of removable clamping designs with different shapes and of different materials.

In the example shown here, pulling on a tab of clamping aid member 76 projecting laterally out of recess 4 has the effect of unrolling the clamping aid member and finally of pulling it out of recess 4, as a result of which the clamping action of second layer 20 in recess 4 is released and first layer 18 is free to expand.

A number of other embodiments of the method according to the invention can also be imagined. The important point in all cases, however, is that sealing tape 16 is inserted into channel-shaped recess 4 in masonry 2, where, either through direct or indirect clamping of second layer 20 against side walls 12 of recess 4 or by means of a plurality of retaining elements, several examples of which have been described and which exert a retaining force on second layer 20 of the sealing tape, the expansion of first layer 18 of sealing tape in recess 4 is at least temporarily limited, whereupon window frame 24 is installed in the area of recess 4 filled by sealing tape 16.

In addition to window replacement, the method according to the invention can also be used to seal other channel-shaped recesses 4 in masonry 2.

In addition to the retaining elements described above, there are also other possibilities, such as the use of retaining clamps (shot technique), chemical fixation of sealing tape 16 in recess 4, etc. The sealing tape can also comprise more than the number of layers described here.

It is also possible to arrange several first layers 18 next to each other on a second layer 20. These several first layers 18 can be arranged directly adjacent to each other or a certain distance apart. The several first layers can all be made of the same material, or they can consist of different materials. The latter option offers advantages, for example, when the permeability to air or vapor diffusion in the inner area is to be different from that in the outer area of the masonry wall ("inside tighter than outside").

Finally, second layer 20 can comprise longitudinal edge profiling in the form of waves or a zigzag pattern or have some other geometric form. This can make it possible to adjust the clamping force of second layer 20 against side walls 12 of recess 4 more precisely, and at the same time it decreases the resistance of second layer 20 as sealing tape 16 is being inserted into recess 4.

Second layer 20 can also be provided with longitudinal, diagonal, or transverse cuts to increase its elasticity, to adapt its width, and to regulate the transverse tension in specific areas.

Reference throughout this specification to "the embodiment," "this embodiment," "the previous embodiment," "one embodiment," "an embodiment," "a preferred embodiment" "another preferred embodiment" "the example," "this example," "the previous example," "one example," "an example," "a preferred example t" "another preferred example" or similar language means that a particular feature, structure, or characteristic described in connection with the embodiment or example is included in at least one embodiment or example of the present invention. Thus, appearances of the phrases "in the embodiment," "in this embodiment," "in the previous embodiment," "in one embodiment," "in an embodiment," "in a preferred embodiment," "in another preferred embodiment," "in the example," "in this example," "in the previous example," "in one example," "in an example," "in a preferred example," "in another preferred example," and similar language throughout this specification may, but do not necessarily, all refer to the same embodiment.

Furthermore, the described features, advantages, and characteristics of the invention may be combined in any suitable manner in one or more embodiments or examples. One skilled in the relevant art will recognize that the invention may be practiced without one or more of the specific features or advantages of a particular embodiment or example. In other instances, additional features and advantages may be recognized in certain embodiments or examples that may not be present in all embodiments of the invention.

While the present invention has been described in connection with certain exemplary or specific embodiments or examples, it is to be understood that the invention is not limited to the disclosed embodiments or examples, but, on the contrary, is intended to cover various modifications, alternatives, modifications and equivalent arrangements as will be apparent to those skilled in the art. Any such changes, modifications, alternatives, modifications, equivalents and the like may be made without departing from the spirit and scope of the invention.

What is claimed is:

1. A method for sealing of replacement windows comprising the steps of:

providing a sealing tape including a first layer of flexible foam which recovers after compression and a second layer of stiff material;

inserting the sealing tape into a channel-shaped recess in a masonry member, the recess being bounded by a bottom and two side walls and comprising an open access section, the first layer of the sealing tape oriented toward the bottom of the recess and at least partially compressed when in the inserted state;

temporarily limiting an expansion of the first layer of the sealing tape by clamping the second layer directly against the side walls of the recess, by clamping the second layer indirectly against the side walls of the recess by use of an intermediate clamping aid member, or by using a plurality of retaining elements which exert a retaining function on the second layer of the sealing tape; and installing a window frame near the open access section of the recess after the step of inserting the sealing tape into the channel-shaped recess and during the temporary limitation of the expansion of the first layer of the sealing tape;

whereby the first layer of the sealing tape expands until the sealing tape rests against the window frame.

2. The method of claim 1 wherein the retaining elements include screws or nails having heads, after the sealing tape has been fitted into the recess the screws or nails are driven through the sealing tape and anchored in the bottom or in the side walls of the recess, whereby the heads of the screws or nails exert the retaining function on the second layer of the sealing tape.

3. The method of claim 1 wherein the retaining elements comprise flat retaining strips which exert the retaining function on the second layer of the sealing tape.

4. The method of claim 3 wherein the retaining elements include screws or nails having heads, after the sealing tape has been fitted into the recess the screws or nails are driven through the sealing tape and anchored in the bottom or in the side walls of the recess, whereby: (a) the heads of the screws or nails project slightly from the second layer of the sealing tape; (b) the flat retaining strips comprise in a middle section thereof an opening and are arranged between the heads of the screws or nails and the sealing tape; and (c) when the retaining strips are in an installed state, the middle section of the flat retaining strips rests against the heads of the screws or nails from underneath.

5. The method of claim 4 wherein when the retaining strips are in the installed state, two side sections of the flat retaining strips rest against the masonry member, one on each side of the recess.

6. The method of claim 4 wherein after the step of inserting the window frame, the additional step of releasing the retaining function is carried out.

7. The method of claim 6 wherein releasing the retaining function is achieved by removal of the retaining strips.

8. The method of claim 1 wherein after the step of inserting the window frame, the additional step of releasing the retaining function is carried out.

9. The method of claim 8 wherein releasing the retaining function is achieved by pulling on at least one laterally projecting pull element which exerts a force on the second layer.

10. The method of claim 9 wherein the pull element is permanently bonded to the second layer of the sealing tape.

11. The method of claim 10 wherein the pull element is formed as a pull tab.

12. The method of claim 1 wherein the second layer of the sealing tape is made of stiff foam.

13. The method of claim 1 wherein the second layer of the sealing tape comprises two clamping sections projecting laterally beyond the first layer of the sealing tape so as to be clamped against the side walls of the recess.

14. The method of claim 1 wherein the first layer and second layer of the sealing tape are permanently bonded to each other.

15. The method of claim 1 wherein the sealing tape comprises a third layer of flexible foam which is permanently bonded to the second layer of the sealing tape on a side of the second layer facing away from the first layer.

* * * * *